US012716034B2

(12) United States Patent
Gautam et al.

(10) Patent No.: US 12,716,034 B2
(45) Date of Patent: Aug. 25, 2026

(54) METHODS FOR CONVERSION OF MIXED PLASTIC WASTES TO A LIQUID HYDROCARBON PRODUCT

(71) Applicant: SABIC Global Technologies B.V., Bergen OP Zoom (NL)

(72) Inventors: Pankaj Gautam, Sugar Land, TX (US); Ravichander Narayanaswamy, Bangalore (IN); Alexander Stanislaus, Bangalore (IN)

(73) Assignee: SABIC Global Technologies B.V., Bergen OP Zoom (NL)

( * ) Notice: Subject to any disclaimer, the term of this patent is extended or adjusted under 35 U.S.C. 154(b) by 362 days.

(21) Appl. No.: 18/699,070

(22) PCT Filed: Oct. 12, 2022

(86) PCT No.: PCT/US2022/077978
§ 371 (c)(1),
(2) Date: Apr. 5, 2024

(87) PCT Pub. No.: WO2023/064816
PCT Pub. Date: Apr. 20, 2023

(65) Prior Publication Data

US 2024/0409829 A1 Dec. 12, 2024

Related U.S. Application Data

(60) Provisional application No. 63/262,391, filed on Oct. 12, 2021.

(51) Int. Cl.
*C10G 51/04* (2006.01)
*C10G 9/00* (2006.01)
(Continued)

(52) U.S. Cl.
CPC ..... *C10G 55/06* (2013.01); *C10G 9/005* (2013.01); *C10G 31/09* (2013.01); *C10G 55/04* (2013.01);
(Continued)

(58) Field of Classification Search
CPC ..... C10G 55/06; C10G 9/005; C10G 31/09; C10G 55/04; C10G 2300/1003;
(Continued)

(56) References Cited

U.S. PATENT DOCUMENTS 4,108,730 A * 8/1978 Chen ..... C10G 1/10 201/23
4,851,601 A * 7/1989 Fukuda ..... C10G 1/002 208/67
(Continued)

FOREIGN PATENT DOCUMENTS

WO 200204529 1/2002
WO 2020084522 4/2020

OTHER PUBLICATIONS

International Search Report for international application No. PCT/US2022/077978, mailed on Jan. 10, 2023.
Extended European search report for European application No. 22881986.8, mailed Jun. 24, 2025.

*Primary Examiner* — Michelle Stein
(74) *Attorney, Agent, or Firm* — Womble Bond Dickinson (US) LLP

(57) ABSTRACT

Systems and methods for processing a mixed plastic waste feed to produce a hydrogen-rich hydrocarbon product, such as synthetic crude oil or pyrolysis oil, by processing the mixed plastic waste feed through two cracking units. The first cracking unit is operated at a temperature and a residence time sufficient to at least partially depolymerize the plastic polymers in the mixed plastic waste feed to produce a molten oligomers product stream also containing inorganic
(Continued)

components from the mixed plastic waste feed and a gas stream. This molten oligomers product stream is further processed in a thermal or a catalytic cracking unit to produce a hydrocarbonaceous stream that is processed to produce the hydrogen-rich hydrocarbon product, such as a synthetic crude oil that can be processed in a refinery or a pyrolysis oil that can be fed to a steam cracker.

20 Claims, 8 Drawing Sheets

(51) Int. Cl.
*C10G 31/09* (2006.01)
*C10G 55/04* (2006.01)
*C10G 55/06* (2006.01)

(52) U.S. Cl.
CPC ..... *C10G 2300/1003* (2013.01); *C10G 2300/202* (2013.01)

(58) Field of Classification Search
CPC .. C10G 2300/202; C10G 11/02; C10G 47/00; C10G 51/04; C10G 67/02; C10G 1/10; Y02P 20/143
See application file for complete search history.

(56) References Cited

U.S. PATENT DOCUMENTS

| | | | | |
|---|---|---|---|---|
| 5,744,668 | A * | 4/1998 | Zhou | C10G 1/10 585/651 |
| 6,270,630 | B1 * | 8/2001 | Xing | F23G 5/20 202/136 |
| 7,691,344 | B2 | 4/2010 | Yoshimura | |
| 9,074,140 | B2 | 7/2015 | Fraczak | |
| 9,096,801 | B2 | 8/2015 | Baker | |
| 9,920,255 | B2 * | 3/2018 | Hofer | C08J 11/12 |
| 10,494,572 | B2 | 12/2019 | Methling | |
| 10,731,081 | B2 | 8/2020 | Ullom | |
| 2009/0299110 | A1 * | 12/2009 | Sarker | C10G 1/10 585/14 |
| 2012/0310023 | A1 * | 12/2012 | Huang | C10G 1/002 585/241 |
| 2016/0024390 | A1 * | 1/2016 | Ullom | C10G 1/086 202/99 |
| 2019/0002664 | A1 | 1/2019 | Streiff et al. | |
| 2019/0016960 | A1 * | 1/2019 | Griffiths | C10B 49/10 |
| 2019/0275486 | A1 | 9/2019 | Peltekis | |
| 2020/0016581 | A1 * | 1/2020 | Gaffney | B01J 23/40 |
| 2021/0355390 | A1 * | 11/2021 | Naik | C10G 11/05 |
| 2024/0368479 | A1 * | 11/2024 | Jangbarwala | B01J 23/02 |

* cited by examiner

METHODS FOR CONVERSION OF MIXED PLASTIC WASTES TO A LIQUID HYDROCARBON PRODUCT

RELATED APPLICATIONS

This application is a U.S. National Phase Under 35 U.S.C. § 371 of International Application No. PCT/US2022/077978, titled "METHODS FOR CONVERSION OF MIXED PLASTIC WASTES TO A LIQUID HYDROCARBON PRODUCT," filed Oct. 12, 2022, which claims the benefit of and priority to U.S. Provisional Application No. 63/262,391, filed on Oct. 12, 2021, which are incorporated herein by reference in their entirety.

TECHNICAL FIELD

The present disclosure generally relates to systems and methods for converting mixed plastic waste (MPW) to a liquid hydrocarbon product, such as synthetic crude oil or pyrolysis oil. More specifically, the present disclosure relates to systems and methods for converting MPW to a synthetic crude oil that is usable for a refinery unit or to a pyrolysis oil that is usable as feed to a steam cracking.

BACKGROUND

Mixed plastic waste is an opportunity feed that can be used to make hydrocarbonaceous products, such as pyrolysis oil or synthetic crude oil, which can be provided as feed to steam crackers or other refinery units. From a carbon efficiency perspective, it is optimal to have high yields of liquid products from the plastic conversion processes. The liquids produced in a decentralized plastic conversion facility can be transported effectively to a central processing facility, like steam crackers or other refinery units. Minimizing gaseous components is required to preserve the hydrogen present in the MPW when it is converted to the liquid products.

The known processes of thermal cracking mixed plastic waste to pyrolysis oil has several drawbacks. For example, high reaction temperature results in lower liquid yields and production of higher quantities of gaseous products that may not be transportable. Combustion of these products results in a carbon loss while lower reaction temperature results in uneconomic batch times and thus low productivity from the unit. This results in typical liquid yields of about 70 weight percent (wt. %) starting from mixed plastic waste. Low carbon efficiency results from the low liquid yields.

High capex intensity results from long residence time. Poor scalability is a direct consequence of long residence time (~10 hours) necessary for thermal cracking among other factors. Batch and semi-batch operation contributes to relatively high capital intensity and operational costs for the thermal processes. Thermal cracking necessitates use of elevated temperatures for cracking, given residence time/liquid yield trade-offs and results in a significant loss of hydrogen rich light gases. Thermal cracking processes target production of light pyoils with a final boiling point of about 400 degrees Celsius (° C.) to about 450° C., which leads to over cracking; and thus production and loss of hydrogen-rich gas. The hydrogen present in the plastic feed is not conserved and lost as part of the gases leading to production of coke and relatively decreased hydrogen content in the liquid product. Moreover, the current pyrolysis oil producers are limited in capacity as they operate on batch or semi-batch mode and few in small scale continuous mode. This restricts the volumes of pyrolysis oil that can be fed into large volume processing units such as steam crackers and refineries. The presence of contaminants restricts processing of large volume of pyrolysis oil. Post-consumer mixed plastic waste inherently has a lot of contaminants, so there is a need for a robust process to generate a synthetic crude oil or pyrolysis oil with high liquid yields in a continuous scalable system. There is an additional need for a system to process MPW into a decontaminated hydrocarbonaceous liquid products that meet the specification limits for use as a feedstock in processing units, like steam crackers or other refinery units.

Moreover, current units need down time for cleaning the plastic pyrolysis/conversion equipment by removing inorganics residue and coke. This can limit the productivity of the unit as these units are not self-cleaning. Moreover, conversion of plastic in pyrolysis unit known commercially takes a long time (8 to 14 hours) which seriously limits the productivity of the unit.

SUMMARY

A need was recognized to mitigate or reduce the down time required for cleaning the plastic pyrolysis/conversion equipment and keep the unit continuously operational. Also, there is a need to increase the productivity of the processing units to convert the MPW to liquid hydrocarbon product. To address one or both of these shortcomings and others in the art, Applicant has developed systems and methods for converting MPW to a liquid hydrocarbon product, such as synthetic crude oil or pyrolysis oil. In certain embodiments, the method of processing a mixed plastic waste feed to produce a hydrogen-rich hydrocarbon product, such as synthetic crude oil or pyrolysis oil, includes the following steps: introducing a mixed plastic waste feed containing a plurality of plastic polymers to a first cracking unit and operating the first cracking unit at a temperature and a residence time sufficient to at least partially depolymerize the plurality of plastic polymers in the mixed plastic waste feed to produce a molten oligomers product stream, which contains inorganic products from the mixed plastic waste feed, and a gas stream. In certain embodiments, the first cracking unit is operated at the temperature ranging from about 300° C. to about 500° C. and the residence time of less than 1 hour. The first cracking unit can be a reactor equipped with an extruder, an auger, a screw, disk ring reactor, kneader, kiln or combinations thereof. In an embodiment, the molten oligomers product stream contains less than ten weight percent (10 wt. %) of additional aromatics not present in feed. In an embodiment, the molten oligomers product stream contains less than 5 wt. % of additional aromatics not present in feed. In certain embodiments, the average molecular weight of the molten oligomers product stream is at least twenty times lower than average molecular weight of the mixed plastic waste feed. The method further includes the steps of hot filtering or settling the molten oligomer product to remove filterable solids and then feeding this stream to a second cracking unit containing a cracking catalyst to produce a first hydrocarbonaceous stream and a first slurry stream containing a portion of the cracking catalyst, trace inorganics, and residual hydrocarbons. This embodiment provides the advantage of upfront removal of inorganics from the molten oligomer product instead of sending the molten oligomer product directly to a catalytic unit. In this embodiment, the inorganics do not mix with catalyst; and hence high purity catalyst can be recovered with lower purge. In certain embodiments, the method includes the steps of directly supplying the molten oligomers product stream to a second cracking unit containing a cracking catalyst to produce a first hydrocarbonaceous stream and a first slurry stream containing a portion of the cracking catalyst, the inorganic products, and residual hydrocarbons. In certain embodiments, the cracking catalyst has a chloride scavenging capability. In an embodiment, the second cracking unit is a continuous cracking unit. In an embodiment, the cracking catalyst favors production of the first hydrocarbonaceous stream with greater paraffin content as compared to iso-paraffin content. In certain embodiments, the MPW is converted to the first hydrocarbonaceous stream in less than two hours. The MPW feed can be converted completely into a lower boiling pyoil or a first hydrocarbonaceous stream in about two to three hours. The MPW feed can be converted completely into a hydrocarbon product like whole crude oil in about less than an hour.

The method further includes the steps of passing the first slurry stream from the second cracking unit to a first separation unit to produce a second slurry stream containing the inorganic products and residual hydrocarbons and a catalyst-rich stream containing the portion of the cracking catalyst. In an embodiment, the catalyst-rich stream is recycled to the second cracking unit. The method further includes the steps of introducing the second slurry stream to a second separation unit to produce a second hydrocarbonaceous stream containing the residual hydrocarbons and an inorganic products-rich stream. In an embodiment, the second separation unit is a coking unit and the second slurry is processed to remove the inorganic products as coke. The method further includes the steps of delivering the first hydrocarbonaceous stream and the second hydrocarbonaceous stream to a distillation unit to produce a distillate stream and a bottoms stream containing residual hydrocarbons, metals, and residual inorganic products; processing the bottoms stream in a third separation unit to remove the metals and the residual inorganic products and to produce a recovered hydrocarbon stream. In certain embodiments, the third separation unit is a coking unit and the bottoms stream is processed to remove the residual inorganic products as coke.

In certain embodiments, the method can further include the step of collecting the molten oligomers product stream in a holding tank to remove heteroatoms as volatiles before supplying the molten oligomer product to the second cracking unit. The method can further include the step of passing a gas stream through the molten oligomers product stream in the holding tank to remove heteroatoms as volatiles before supplying the molten oligomer product to the second cracking unit.

In certain embodiments, the recovered hydrocarbon stream is mixed with the distillate stream to produce to a liquid hydrocarbon product, such as synthetic crude oil or pyrolysis oil. In certain embodiments, the method further includes the steps of passing the molten oligomers product stream to a melt filtration unit to remove a portion of the inorganic products and insoluble components before supplying the molten oligomer product to the second cracking unit. In certain embodiments, the method further includes passing the molten oligomers product stream to a fourth separation unit to remove one or more light gases containing volatile hydrocarbons rich in one or more of chloride, nitride, and sulfide before supplying the molten oligomer product to the second cracking unit. In certain embodiments, the fourth separation unit is a vacuum separation unit. In certain embodiments, the method further includes the step of adding a depolymerization additive to the mixed plastic waste feed in the first cracking unit. The depolymerization additive can be one or more of a depolymerization accelerator, a peroxide, an organometallic compound, oxygen or oxygen containing species or a cracking catalyst.

Embodiments also include systems for processing a mixed plastic waste feed to produce a liquid hydrocarbon product, such as synthetic crude oil or pyrolysis oil. One such system includes a first cracking unit with a first inlet, a mixing element, and a first outlet. The first inlet has an opening to receive therethrough a mixed plastic waste feed containing a plurality of plastic polymers. This first cracking unit further contains a heat source to heat the mixed plastic waste feed to a temperature sufficient to at least partially depolymerize the plurality of plastic polymers in the mixed plastic waste feed to produce a molten oligomers product stream containing inorganic products from the mixed plastic waste feed. The first cracking unit can be a reactor equipped with an extruder, an auger, a screw, disk ring reactor, kneader, kiln or combinations thereof. In an embodiment, the molten oligomers product stream contains less than 10 wt. % of additional aromatics not present in feed. In an embodiment, the molten oligomers product stream contains less than 5 wt. % of additional aromatics not present in feed. In certain embodiments, the average molecular weight of the molten oligomers product stream is at least twenty times lower than average molecular weight of the mixed plastic waste feed. The system further includes a second cracking unit with a second inlet, a third inlet, a second outlet, and a third outlet. The second inlet is connected to and in fluid communication with the first outlet to receive the molten oligomers product stream, and the second cracking unit is configured to contact the molten oligomers product stream with a cracking catalyst to produce a first hydrocarbonaceous stream and a first slurry stream containing a portion of the cracking catalyst, the inorganic products, and residual hydrocarbons. The system further includes a first separation unit with a fourth inlet, a fourth outlet, and a fifth outlet. The fourth inlet is connected to and in fluid communication with the second outlet to receive the first slurry stream. The first separation unit is configured to produce a second slurry stream containing the inorganic products and the residual hydrocarbons and a catalyst-rich stream containing the portion of the cracking catalyst. The fourth outlet is connected to and in fluid communication with the third inlet to supply the catalyst-rich stream to the second cracking unit. The system further includes a second separation unit with a fifth inlet and a sixth outlet. The fifth inlet is connected to and in fluid communication with the fifth outlet to receive the second slurry stream. The second separation unit is configured to produce an inorganic products-rich stream and a second hydrocarbonaceous stream containing the residual hydrocarbons. The system further includes a distillation unit with a sixth inlet, a seventh outlet, and an eighth outlet. The sixth inlet is connected to and in fluid communication with the third outlet to receive the first hydrocarbonaceous stream and with the sixth outlet to receive the second hydrocarbonaceous stream. The distillation unit is configured to produce a distillate stream and a bottoms stream containing residual hydrocarbons, metals, and residual inorganic products. The system further includes a third separation unit with a seventh inlet and a ninth outlet. The seventh inlet is connected to and in fluid communication with the eighth outlet to receive the bottoms stream. The third separation unit is configured to remove the metals and the residual inorganic products and to produce a recovered hydrocarbons stream. The system further includes a mixer with an eighth inlet and a ninth inlet. The eighth inlet is connected to and in fluid communication with the seventh outlet to receive the distillate stream, and the ninth inlet is connected to and in fluid communication with the ninth outlet to receive the recovered hydrocarbon stream. In the mixer, the recovered hydrocarbon stream combines with the distillate stream to produce the liquid hydrocarbon product, such as synthetic crude oil or pyrolysis oil.

Another such system for processing a mixed plastic waste feed to produce a liquid hydrocarbon product, such as synthetic crude oil or pyrolysis oil, includes a first cracking unit with a first inlet, a mixing element, and a first outlet. The first inlet has an opening to receive therethrough a mixed plastic waste feed containing a plurality of plastic polymers. The first cracking unit further contains a heat source to heat the mixed plastic waste feed to a temperature sufficient to at least partially depolymerize the plurality of plastic polymers in the mixed plastic waste feed to produce a molten oligomers product stream containing inorganic products from the mixed plastic waste feed. The system further includes a second cracking unit with a second inlet, a second outlet, and a third outlet. The second inlet is connected to and in fluid communication with the first outlet to receive the molten oligomers product stream. The second cracking unit is a thermal cracking unit configured to process the molten oligomers product stream to produce a first hydrocarbonaceous stream and a slurry stream containing the inorganic products and residual hydrocarbons. The system further includes a first separation unit with a third inlet and a fourth outlet. The third inlet is connected to and in fluid communication with the second outlet to receive the slurry stream. The first separation unit is configured to produce an inorganic products-rich stream and a second hydrocarbonaceous stream containing the residual hydrocarbons. The system further includes a distillation unit with a fourth inlet, a fifth outlet, and a sixth outlet. The fourth inlet is connected to and in fluid communication with the third outlet to receive the first hydrocarbonaceous stream and with the fourth outlet to receive the second hydrocarbonaceous stream. The distillation unit is configured to produce a distillate stream and a bottoms stream containing residual hydrocarbons, metals, and residual inorganic products. The system further includes a second separation unit with a fifth inlet and a seventh outlet. The fifth inlet is connected to and in fluid communication with the sixth outlet to receive the bottoms stream. The second separation unit is configured to remove the metals and the residual inorganic products and to produce a recovered hydrocarbon stream. The system further includes a mixer with a sixth inlet and a seventh inlet. The sixth inlet is connected to and in fluid communication with the fifth outlet to receive the recovered hydrocarbon stream. The seventh inlet is connected to and in fluid communication with the seventh outlet to receive the distillate stream. The mixer is configured to combine the recovered hydrocarbon stream and the distillate stream to produce the liquid hydrocarbon product, such as synthetic crude oil or pyrolysis oil.

Still other aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than may be necessary for a fundamental understanding of the embodiments discussed herein and the various ways in which they may be practiced. According to common practice, the various features of the drawings discussed below are not necessarily drawn to scale. Dimensions of various features and elements in the drawings may be expanded or reduced to more clearly illustrate embodiments of the disclosure.

DETAILED DESCRIPTION

Figure 1:
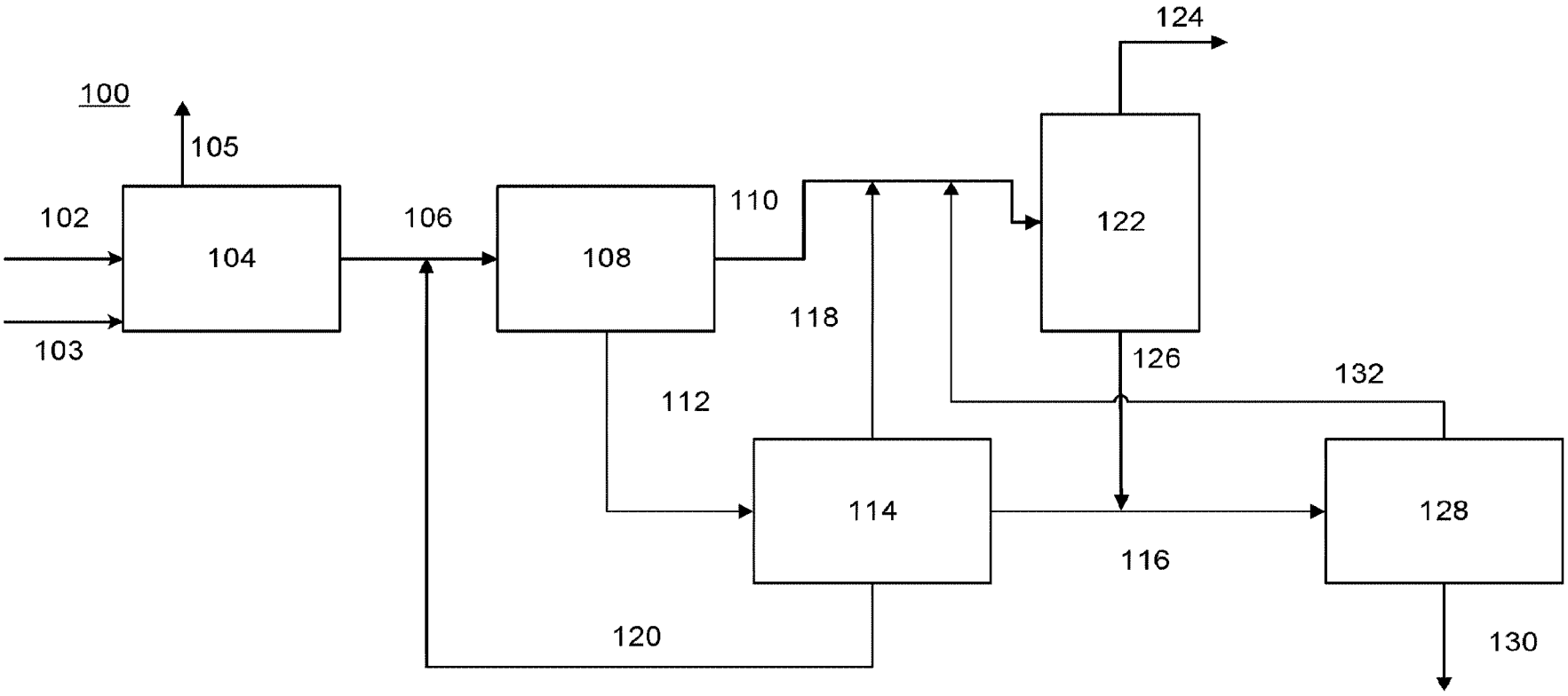
FIG. 1 is a block diagram of a method of processing a mixed plastic waste feed to produce a liquid hydrocarbon product, such as synthetic crude oil or pyrolysis oil, according to an embodiment.

The present disclosure describes various embodiments related to processes, devices, and systems for converting MPW to a hydrogen-rich hydrocarbon product, such as synthetic crude oil or pyrolysis oil. More specifically, the present disclosure relates to systems and methods for converting MPW to a synthetic crude oil that is usable for a refinery unit or to a pyrolysis oil that is usable as feed to a steam cracking. These systems and methods produce lighter pyrolysis oil (lighter than crude oil) which can be fed to a steam cracker. In certain embodiment, these pyrolysis systems and methods produce about 85% liquid products as compared to the commercially known processes for producing steam cracker feed pyoils that produce about 70% liquid products. Further embodiments may be described and disclosed. In the following description, numerous details are set forth in order to provide a thorough understanding of the various embodiments. In other instances, well-known processes, devices, and systems may not have been described in particular detail in order not to unnecessarily obscure the various embodiments. Additionally, illustrations of the various embodiments may omit certain features or details in order to not obscure the various embodiments.

The description may use the phrases "in certain embodiments," "in various embodiments," "in an embodiment," or "in embodiments," which may each refer to one or more of the same or different embodiments. Furthermore, the terms "comprising," "including," "having," and the like, as used with respect to embodiments of the present disclosure, are synonymous. The term "about" or "approximately" are defined as being close to as understood by one of ordinary skill in the art. In one non-limiting embodiment, the terms are defined to be within 10%, preferably within 5%, more preferably within 1%, and most preferably within 0.5%.

The terms "removing," "removed," "reducing," "reduced," or any variation thereof, when used in the claims and/or the specification includes any measurable decrease of one or more components in a mixture to achieve a desired result. The use of the words "a" or "an" when used in conjunction with any of the terms "comprising," "including," "containing," or "having," in the claims or the specification may mean "one," but it is also consistent with the meaning of "one or more," "at least one," and "one or more than one." The terms "wt. %", "vol. %", or "mol. %" refers to a weight, volume, or molar percentage of a component, respectively, based on the total weight, the total volume of material, or total moles, that includes the component. In a non-limiting example, 10 grams of component in 100 grams of the material is 10 wt. % of component.

In certain embodiments, the method of processing a mixed plastic waste feed to produce the liquid hydrocarbon product, such as synthetic crude oil or pyrolysis oil includes the following steps: introducing a mixed plastic waste feed containing a plurality of plastic polymers to a first cracking unit and operating the first cracking unit at a temperature and a residence time sufficient to at least partially depolymerize the plurality of plastic polymers in the mixed plastic waste feed to produce a molten oligomers product stream (which also contains inorganic products from the mixed plastic waste feed) and a gas stream. In certain embodiments, the first cracking unit is operated at the temperature ranging from about 220° C. to about 500° C. and the residence time of less than 1 hour. The first cracking unit can be a reactor equipped with an extruder, an auger, a screw, disk ring reactor, kneader, kiln, stirred tank reactor, tubular reactor or combinations thereof. In an embodiment, the molten oligomers product stream contains less than 10 wt. % of additional aromatics not present in feed (typically <5 wt %). In an embodiment, the molten oligomers product stream contains less than 5 wt. % of additional aromatics not present in feed. In certain embodiments, the average molecular weight of the molten oligomers product stream is at least twenty times lower than average molecular weight of the mixed plastic waste feed. In certain embodiments, the first cracking unit is equipped with a thermally or electrically heated auger or extruder to partially depolymerize the polymer chains into a waxy fluid having a molecular weight of less than 20,000 Daltons. The waxy fluid can optionally be hot filtered to remove inorganics and other insolubles. Vacuum can optionally be used to pull out light gases containing volatile hydrocarbons rich in chlorine, nitrogen, sulfur and other heteroatoms. Valuable chemicals can be separated from light gases thus recovered while other hydrocarbons can optionally be used as fuels.

The hot filtered oligomer stream is optionally collected in a hot feed tank, before feeding the second cracking unit, which provides additional residence time to remove further heteroatoms as volatiles. This hot feed tank can be under vacuum or purged and/or bubbled with gas stream to help in removing volatiles. The hold-up time in this hot feed tank assists in further cracking and removal of heteroatoms.

The method further includes the steps of supplying the molten oligomers product stream to a second cracking unit containing a cracking catalyst to produce a first hydrocarbonaceous stream and a first slurry stream containing a portion of the cracking catalyst, the inorganic products, and residual hydrocarbons. In an embodiment, the second cracking unit is a continuous cracking unit. In certain embodiments, the cracking catalyst has a chloride scavenging capability. In certain embodiments, the cracking catalyst is an acidic catalyst to further crack polymer chains. In an embodiment, the cracking catalyst favors production of the first hydrocarbonaceous stream with greater paraffin content as compared to iso-paraffin content. In certain embodiments, the mixed plastic waste feed is fed continuously and converted to the first hydrocarbonaceous stream in less than two and half hours in the catalytic reactor. In certain embodiments, the MPW is converted to the first hydrocarbonaceous stream in less than two hours. The MPW feed can be converted completely into a lower boiling pyoil or a first hydrocarbonaceous stream in about two to three hours. The MPW feed can be converted completely into a hydrocarbon product like whole crude oil in about less than an hour. In an embodiment, the second cracking unit is a batch reactor to convert the molten oligomers product stream to liquids that can optionally be distilled to separate into streams of desired compositions. In an embodiment, the catalytic cracking unit is a batch reactor to convert the mixed plastic waste feed to liquids that can optionally be distilled to separate into streams of desired compositions.

The method further includes the steps of passing the first slurry stream from the second cracking unit to a first separation unit to produce a second slurry stream containing the inorganic products and residual hydrocarbons and a catalyst-rich stream containing the portion of the cracking catalyst. In an embodiment, the catalyst-rich stream is recycled to the second cracking unit. The method further includes the steps of introducing the second slurry stream to a second separation unit to produce a second hydrocarbonaceous stream containing the residual hydrocarbons and an inorganic products-rich stream. In an embodiment, the second separation unit is a coking unit and the second slurry is processed to remove the inorganic products and drop metal content in feed as coke. The method further includes the steps of delivering the first hydrocarbonaceous stream and the second hydrocarbonaceous stream to a distillation unit to produce a distillate stream and a bottoms stream containing residual hydrocarbons, metals, and residual inorganic products; processing the bottoms stream in a third separation unit to remove the metals and the residual inorganic products and to produce a recovered hydrocarbon stream. In certain embodiments, the third separation unit is a coking unit and the bottoms stream is processed to remove the residual inorganic products as coke along with metals in feed. In certain embodiments, the recovered hydrocarbon stream is mixed with the distillate stream to produce the liquid hydrocarbon product, such as synthetic crude oil or pyrolysis oil. In certain embodiments, the method further includes the steps of passing the molten oligomers product stream to a melt filtration unit to remove a portion of the inorganic products and insoluble components before supplying the molten oligomer product to the second cracking unit. In certain embodiments, the method further includes passing the molten oligomers product stream to a fourth separation unit to remove one or more light gases containing volatile hydrocarbons rich in one or more of chloride, nitride, and sulfide before supplying the molten oligomer product to the second cracking unit. In certain embodiments, the fourth separation unit is a vacuum separation unit, or a hot feed holding tank with gas head space purge and/or bubbling. In certain embodiments, the method further includes the step of adding a depolymerization additive to the mixed plastic waste feed in the first cracking unit. The depolymerization additive can be one or more of a depolymerization accelerator, a peroxide, an organometallic compound, oxygen or oxygen containing species or a cracking catalyst.

Embodiments of the methods described herein achieve high carbon efficiency. The catalytic cracking can be carried out under lower temperature and residence time conditions. For example, the methods described here can typically be completed within a residence time of about an hour as compared to about ten hours for thermal cracking. This results in considerably higher liquid yields and improved carbon efficiency over traditional thermal cracking process. These methods also result in lower capex intensity due to improved scalability and also higher hydrogen content in synthetic crude. Reduced temperature and pressure conditions for catalytic cracking produce comparatively reduced quantities of hydrogen-rich light gases. Thus, the hydrogen content of the products generated through these methods is greater than the conventional thermal cracking process. In certain embodiments, the methods and systems disclosed here provide for an overall shorter residence time in the cracking units, which also results in production of low aromatics of less than 10 wt. % that are new aromatics not present in the feed. In some embodiments, the aromatic content is less than about 5 wt. %.

In another aspect of the methods and systems disclosed here, the first cracking unit includes a melt filtration unit and the first cracking occurs in units, such as an auger/extruder/twin screw reactor/disk ring reactor/kneader/kiln/stirred tank reactors/tubular reactors. In another embodiment, the heavy ends of the molten oligomers product stream, which is enriched with metal contaminants, from the second cracking unit, is separated from the catalyst and subjected to a coking step to maximize recovery of decontaminated liquids. The metal contaminants from the MPW are now rejected as coke. The catalyst is recycled to the reactor continuously for supporting further reactions.

FIG. 1 is a block diagram of a method 100 of processing a mixed plastic waste feed to produce a synthetic crude oil, according to an embodiment. This method 100 includes the step of introducing a mixed plastic waste feed 102 containing a plurality of plastic polymers to a first cracking unit 104 and operating the first cracking unit 104 at a temperature and a residence time sufficient to at least partially depolymerize the plurality of plastic polymers in the mixed plastic waste feed 102 to produce a gas stream 105 and a molten oligomers product stream 106 containing inorganic products from the mixed plastic waste feed 102. In an embodiment, the first cracking unit 104 is a continuous reactor. In certain embodiments, the first cracking unit 104 can include one of the following: an extruder, an auger, a screw feeder, a piston in a feed chamber, a block and feed type of manifold, a disk ring reactor, a kneader, a kiln, a stirred tank reactor, tubular reactor, or combinations thereof. The first cracking unit 104 is equipped with a heating mechanism. In an embodiment, the heating mechanism is disposed along the length thereof of the unit equipped an extruder, an auger, or a screw feeder, a disk ring reactor, a kneader, a kiln, a stirred tank reactor, or tubular reactor. In certain embodiments, a combination of arrangement of screw or mixing elements/internals is arranged to increase heat transfer throughout the mixed plastic waste feed 102. The first cracking unit 104 is an equipment which promotes high degree of heat transfer, provides large surface areas and continuous renewal of surfaces and is capable of handling high viscosity melts. This combination allows to optimize the reaction conditions, such that the heat transfer issues associated with high viscosity melts is addressed in an equipment configured to handle uniform mixing/kneading and conveying the mixed plastic waste feed 102 with minimal wall layer build ups and self-cleaning. In certain embodiments, operation of this first cracking unit 104 leads to production of reduced gas. When this first cracking unit 104 is operated in combination with a second catalytic cracking unit, there is increased efficiency in the catalytic cracking step. In certain embodiments, the molten oligomers product stream 106 is subject to uniform mixing at low residence time of less than one hour and a low temperature gradient in the second cracking unit. The overall gas production is reduced in this method 100 of manufacturing of the synthetic crude oil. In certain embodiments, the first cracking unit 104 can include a gas inlet 103 configured to provide continuous gas flow co-current to flow in the first cracking unit 104 and one or more gas streams 105 to remove cracked gas, hydrogen chloride, other heteroatom-containing volatiles formed in the first cracking unit to reduce formation of organic chlorides by recombination. The gas feed through the gas inlet 103 can be inert gases like $N_2$, $CO_2$ and others, process hydrocarbon gases after removal of heteroatom volatiles, hot flue gases produced from combustion of process gases after removal of heteroatom volatiles or their combinations. In certain embodiments, the other heteroatom volatiles can include ammonia, organic amines, nitro-compounds, hydrogen cyanide, oxygen-containing compounds, or combinations thereof. The gas streams 105 exiting the first cracking unit 104 can include hydrogen, methane, ethane, propane, butane, $C_2$ to $C_4$ olefins, higher hydrocarbons, cracked gases, heteroatom volatiles, nitrogen, or combinations thereof. In certain embodiments, the gas product from the partial depolymerization is subjected to further condensation to generate a condensable hydrocarbon liquid and a non-condensable gas. The non-condensable gases can include hydrogen, methane, ethane, propane, butane, $C_2$ to $C_4$ olefins and heteroatom volatiles and components of gas streams introduced as stream through gas inlet 103. The condensable hydrocarbon liquids include hydrocarbons from $C_5$-$C_{22}$ hydrocarbons. The condensable hydrocarbon liquid is processed with hydrocarbonaceous streams from the method to produce the synthetic crude oil.

In certain embodiments where the first cracking unit 104 is one or more of an extruder, a twin screw reactor, an auger reactor, a disk ring reactor, or a kneader, where there is a narrow clearance between screw and barrel. This arrangement provides an environment of intense heat transfer that ensures that no portion of the melt bypasses or short circuits the heated flow path provided between the inlet to the outlet of the reactor. The mixing element (such as the screw or auger element) in the reactor ensures a thorough mixing of content of the reactor, a more uniform cross sectional temperature in the reactor cross section, and conveying of material from inlet to outlet. The reactor is externally heated with temperature set point controls to impose a temperature profile along the reactor length from inlet to outlet. This temperature profile can be varied for improved operations of the reactor. The reactor also has provision for feeding a sweep gas from inlet to outlet so as to remove gas products generated in the process. This sweep gas can be an inert gas under the processing environment. For example, this sweep gas can be a recycle gas from the product containing $C_1$ to $C_4$ hydrocarbon, inert gas like nitrogen, or can also be a hot flue gas to remove gas products generated in the process as well provide a direct heating.

In an embodiment, the first cracking unit 104 is operated at a temperature ranging from about 220 to about 500 degrees Celsius (° C.). The operating temperature can also range more specifically from about 380 to about 450° C. In an embodiment, the first cracking unit 104 is operated at a residence time of less than 15 minutes. In an embodiment, the first cracking unit 104 is operated at a residence time of less than 5 minutes. The reduced residence time of the mixed plastic waste feed 102 in the first cracking unit 104 reduces gas loss and ensures the cracking of plastics in the mixed plastic waste feed 102 to molten oligomers product stream 106. This stream 106 can be a hydrocarbonaceous wax stream containing compounds of lower molecular weight (<20,000 Daltons). This processing step reduces the time required in the second cracking unit 108 for cracking the molten oligomers product stream 106 into crude oil boiling range components. This also reduces the loss of liquid components as gaseous products. In certain embodiments, the molten oligomers product stream has a low viscosity of less than 10 centipoise (cP) at the temperature ranging from 400° C. to 450° C. In certain embodiments, the molten oligomers product stream has a low viscosity of less than 5 cP at the temperature ranging from 400° C. to 450° C. This processing step ensures that the second cracking unit 108 does not receive a highly viscous stream at operating temperatures with substantial heat transfer issues.

Certain embodiments include the use of one or more depolymerization additives to the first cracking unit 104 to accelerate the rate of partial depolymerization. The depolymerization additives can include a depolymerization accelerator/organometallic compound, a cracking catalyst, or combinations thereof. The depolymerization accelerator/organometallic compound can include a metal octanoate, metal naphthenate, metal stearate, metallocenes, or combinations thereof. The metal in the organometallic compound can be Ni, Mo, Co, W, Fe, transitional metals, or combinations thereof. In certain embodiments, the solid catalyst/additives are configured to accelerate the depolymerization rate in the first cracking unit so that the targeted molecular weight reduction can be achieved at a reduced residence time. Non-limiting examples of solid catalysts/additives include an inorganic oxide, aluminosilicates including ZSM-5, an X-type zeolite, a Y-type zeolite, a USY-zeolite, mordenite, faujasite, nano-crystalline zeolites, MCM mesoporous materials, SBA-15, a silico-alumino phosphate, a gallium phosphate, and a titanophosphate, a molecular sieve, or combinations thereof. In certain embodiments, the depolymerization additives can be present in the liquid form. Certain embodiments include use of a depolymerization additive that functions to scavenge chlorides and enhance production of straight chain hydrocarbons over branched hydrocarbons. For example, metal loaded aluminosilicates can be used to facilitate the scavenging of chlorides as well as enhancing straight chain hydrocarbons over branched hydrocarbons.

In certain embodiments, the mixed plastic waste feed 102 used in the continuous reactor, like an extruder, a twin screw reactor, an auger reactor, a kneader, a disk ring reactor, a kiln, a stirred tank reactor or a tubular reactor, is associated with substantial amount of inorganics, such as fillers and additives. Thus, as the molten oligomers product stream 106 also contains these inorganics, this stream 106 is hot filtered optionally to remove the inorganics. This molten oligomers product stream 106 can fed to the catalytic cracking unit for further cracking in the second cracking unit 108 to produce the liquid hydrocarbon product, such as synthetic crude oil or pyrolysis oil. The molten oligomer product stream can optionally be collected in a hot feed tank before feeding to second cracking unit 108. The holdup time in hot feed tank provides additional time for removal of heteroatom volatiles.

In the second cracking unit 108, the molten oligomers product stream 106 is further cracked to a first hydrocarbonaceous stream 110 and a first slurry stream 112 with a relatively short residence time of less than one hour. The shorter residence time prevents over-cracking and loss of hydrogen and hydrogen-rich gases from the molten oligomers product stream 106. The first slurry stream 112 contains a portion of the cracking catalyst, the inorganic products, and residual hydrocarbons. In certain embodiments, some of these hydrocarbons generated leave the second cracking unit 108 as a lighter overhead product (gas and condensable liquid). This fraction of gas and condensable liquid is subjected to further condensation to generate a condensable hydrocarbon liquid and a non-condensable gas. The condensable hydrocarbon liquid is processed with hydrocarbonaceous streams from the method to produce the liquid hydrocarbon product, such as synthetic crude oil or pyrolysis oil. In certain embodiments, the first hydrocarbonaceous stream has chloride levels of less than 1 ppmw (parts per million by weight) and olefin content of less than 1 wt. %.

In certain embodiments, the second cracking unit 108 is a catalytic cracking unit operated at a temperature ranging from about 300° C. to about 500° C. Depending on the catalyst and other operating conditions, the operating temperature can also range more specifically from about 390° C. to about 450° C. In an embodiment, the catalytic cracking unit is operated at a residence time of less than 2.5 hours. In an embodiment, the catalytic cracking unit is operated at a residence time of less than one hour. In an embodiment, the catalytic cracking unit is operated with a catalyst loading of 10 wt. % or less. In an embodiment, the catalytic cracking unit is operated with a catalyst loading of 5 wt. % or less on feed to the catalytic cracking unit. In certain embodiments, the hydrogen gas is supplied to the second cracking unit to produce the first hydrocarbonaceous stream with chloride levels of less than 1 ppmw and olefin content of less than 1 wt. %.

In certain embodiments, the second cracking unit 108 is one of many types of a catalytic cracking reactor, such as a slurry stirred tank reactor, bubble column reactor or a tubular reactor with a pump around loop for circulation/mixing. The stirred tank reactor can be equipped with multi-stage agitator. The stirred tank reactor can be fitted with two-stage agitators. For example, the agitators can be propellers and turbine blades at different levels. In an embodiment, the bottom-most agitator is a propeller that lifts the catalyst for the subsequent turbine to uniformly mix. The reactor also has provision for gas injection, such as hydrogen or hydrogen-containing. This gas facilitates the maintenance of certain degree of saturation of cracked products in the reactor as the catalyst used has metal promoters which can promote hydrogenation. In an embodiment, the gas used here is a cracked gas from the process or molecular hydrogen. In addition, this process of gas injection helps in stripping contaminants, like chlorine, nitrogen, and sulphur containing compounds from the reactor contents. The reduction of unsaturation and contaminant removal as a result of use of this gas injection permits blending of larger quantities of the synthetic crude oil or naphtha feeds produced into refinery or steam cracker. In certain embodiments, the reactor could be a bubble column reactor with forced circulation of reactor content using a circulating pump with provision for gas injection as above. In certain embodiments, the catalyst used in the process is a zeolite catalyst. The zeolite catalyst can be a metal loaded zeolite catalyst. In certain embodiments, the metal component of the catalyst helps in scavenging trace chlorides and also increases the linearity of products to produce a higher n-paraffin to isoparaffin ratio (>1.5). These linear products when processed in steam cracker maximizes production of ethylene.

Examples of metals present in the catalyst include magnesium, nickel, cobalt, or any transition metals or combinations. Magnesium helps in scavenging chlorides and also improves the n-paraffin to isoparaffin ratio. Nickel and other transition metals help in linearity of the products and also aid in saturating the liquid product in the presence of hydrogen or hydrogen containing gas. The catalyst can include one or more of an inorganic oxide, aluminosilicates including ZSM-5, an X-type zeolite, a Y-type zeolite, a USY-zeolite, mordenite, faujasite, nano-crystalline zeolites, MCM mesoporous materials, SBA-15, a silico-alumino phosphate, a gallium phosphate, a titanophosphate or molecular sieve, metal loaded aluminosilicate, or combinations thereof which aid in cracking. Examples of catalysts configured to scavenge chlorides and enhance production of straight chain hydrocarbons over branched hydrocarbons include 15% Mg on ZSM-5 commercial FCC additive, 15% Mg with 8% Nickel on ZSM-5 commercial FCC additive, or a combination of spent FCC catalyst from the refinery unit with added 15% Mg on ZSM-5 commercial FCC additive or added 15% Mg with 8% Ni on ZSM-5 commercial FCC additive. In certain embodiments, the metals can also be loaded on spent FCC catalyst.

This method 100 includes the step of supplying the first slurry stream 112 continuously to a first separation unit 114 to produce a second slurry stream 116 containing the inorganic products and residual hydrocarbons and a catalyst-rich stream 120 containing the portion of the cracking catalyst. The catalyst-rich stream 120 is recycled to the second cracking unit 108. In experiments involving first slurry stream 112, the catalyst has a high tendency to settle faster while the inorganic material is well dispersed in the hydrocarbonaceous stream and settles slowly. In an embodiment, this difference in the rate of settling between the inorganic material and catalyst is utilized in the slurry settler to separate these components. The catalyst-rich stream 120 containing the portion of the cracking catalyst is recycled from the slurry settler to the catalytic cracking unit and a portion of the same is periodically sent for regeneration and reuse/purge.

The second slurry stream 116 is supplied to a second separation unit 128 to produce an inorganic products-rich stream 130 and a second hydrocarbonaceous stream 132 containing the residual hydrocarbons. The first hydrocarbonaceous stream 110 and the second hydrocarbonaceous stream 132 are supplied to a distillation unit 122 to produce a distillate stream 124 and a bottoms stream 126 containing residual hydrocarbons, metals, and residual inorganic products. In certain embodiments, the bottoms stream 126 is supplied to the second separation unit 128 or second cracking unit 108. In other embodiments, the bottoms stream 126 is supplied to a third separation unit to remove the metals and the residual inorganic products and to produce a recovered hydrocarbon stream. The recovered hydrocarbon stream is combined with the distillate stream to produce the liquid hydrocarbon product, such as synthetic crude oil or pyrolysis oil.

In certain embodiments, the inorganics-rich stream from the second separation unit is supplied to a coking unit so as to reject heteroatoms from the hydrocarbon stream as coke. In certain embodiments, the inorganics-rich stream 130 from the second separation unit 128 is combined with the bottoms stream 126 and supplied to the coking unit. The recovered hydrocarbon from the coking unit is then introduced into the distillation unit 122 so that it is combined with the first hydrocarbonaceous stream 110 and the second hydrocarbonaceous stream 132 to generate the liquid hydrocarbon product, such as synthetic crude oil or pyrolysis oil. This synthetic crude can be further distilled if required to generate a steam cracker feed cut or for separating out heavy ends containing heteroatoms. This heavy end from the distillation is fed back to the coking unit. Embodiment also include a coking unit with feeds from the inorganic products-rich stream 130, the bottoms stream 126, and the product recovered hydrocarbon stream going to the distillation unit. The coking unit is operated in a temperature ranging from about 400° C. to about 530° C. The coking unit can have a standby unit available for removal of coke and for keeping the operations continuous. The slurry settler is operated with a holdup time of less than 15 min, preferably 3 to 5 min or less for easy separation of catalyst from the inorganics.

Figure 2:
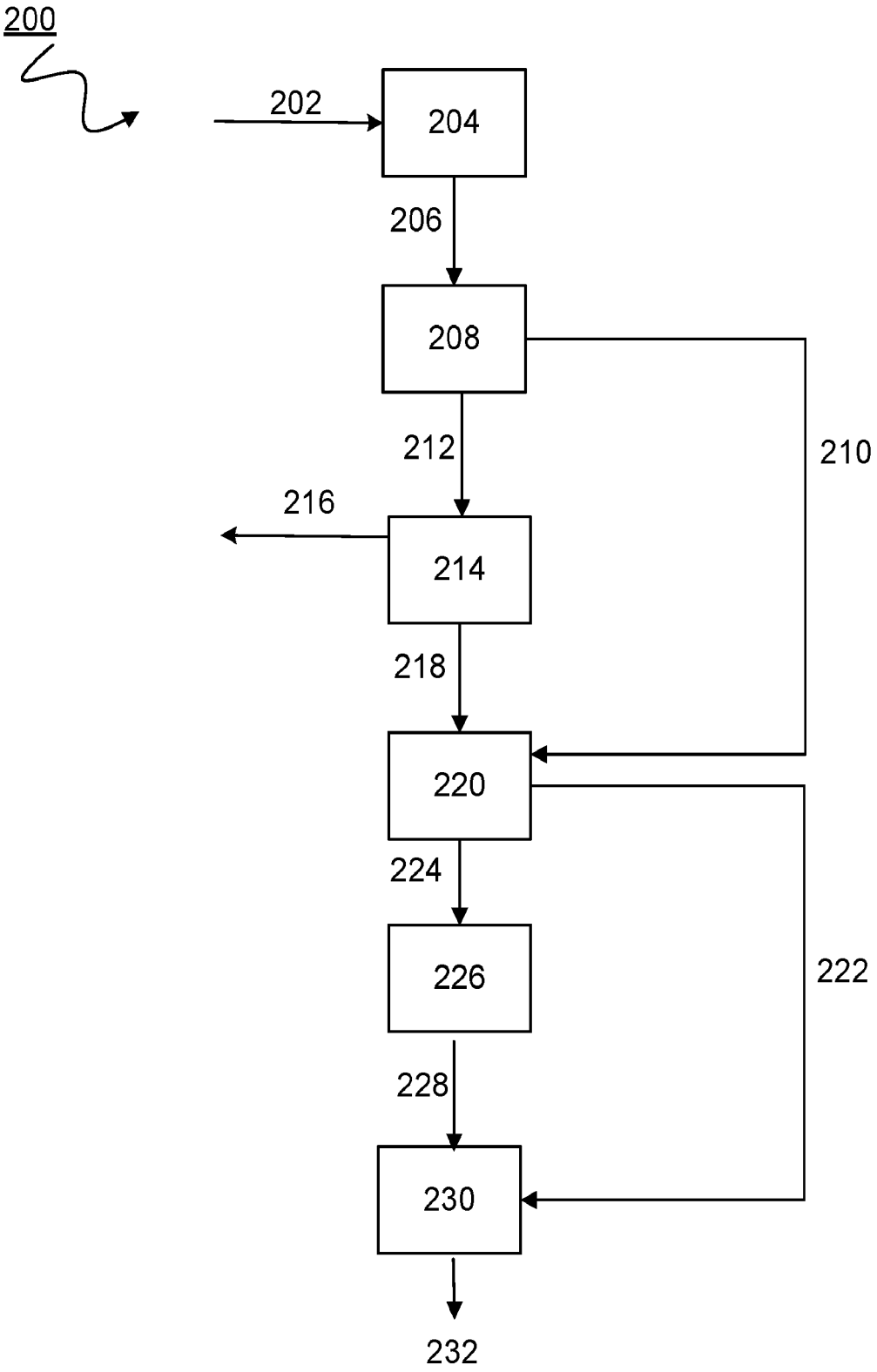
FIG. 2 is a block diagram of a system for processing a mixed plastic waste feed to produce a liquid hydrocarbon product, such as synthetic crude oil or pyrolysis oil, according to an embodiment.

Embodiments also include systems for processing a mixed plastic waste feed to produce a liquid hydrocarbon product, such as synthetic crude oil or pyrolysis oil. FIG. 2 is a block diagram of a system 200 for processing a mixed plastic waste feed to produce a liquid hydrocarbon product, such as synthetic crude oil or pyrolysis oil, according to an embodiment. This system for processing a mixed plastic waste feed 202 to produce a liquid hydrocarbon product includes a first cracking 204 unit with a first inlet, a mixing element, and a first outlet. The first inlet has an opening to receive therethrough a mixed plastic waste feed 202 containing a plurality of plastic polymers. The first cracking unit 204 further contains a heat source to heat the mixed plastic waste feed to a temperature sufficient to at least partially depolymerize the plurality of plastic polymers in the mixed plastic waste feed 202 to produce a molten oligomers product stream 206 containing inorganic products from the mixed plastic waste feed. In an embodiment, the molten oligomers product stream is supplied to a melt filtration system or a settler to remove a portion of the inorganic components in the molten oligomers product stream 206 before supplying this stream to a second cracking unit 208. The molten oligomers product stream from the first cracking unit 204 can be processed in several ways to produce the filtered oligomer stream 206. In an embodiment, the molten oligomers product stream is subject to hot filtration and then sent to the second cracking unit 208. In an embodiment, the molten oligomers product stream is subject to hot filtration, subsequently held in a hot feed tank, and then sent to the second cracking unit 208. Additional residence time is provided in the hot feed tank for removing volatile heteroatom compounds. In another embodiment, the molten oligomers product stream from the first cracking unit 204 is settled in a slurry settler and the clear liquid oligomers product stream is fed to the hot feed tank and then to the second cracking unit 208. In another embodiment, the molten oligomers product stream from the first cracking unit 204 is fed directly to the second cracking unit 208.

The system 200 further includes a second cracking unit 208 with a second inlet, a second outlet, and a third outlet. The second inlet is connected to and in fluid communication with the first outlet to receive the molten oligomers product stream 206. The second cracking unit 208 is a thermal cracking unit configured to process the molten oligomers product stream to produce a first hydrocarbonaceous stream 210 and a slurry stream 212 containing the inorganic products and residual hydrocarbons. The second cracking unit 208 is operated in a thermal cracking mode at a reaction temperature of about 400° C. to 450° C. with a residence time of about one hour to produce a crude oil and about 2 to 3 hours for producing a pyrolysis oil that can be fed to steam cracker. In an embodiment, to achieve a similar boiling point distribution as in the case of a system employing catalysts, the thermal reactor system is operated for a 15 to 30 minute longer residence time.

In certain embodiments, the system 200 further includes a condenser and a gas-liquid separator that is configured to receive gaseous products from one or more of the first cracking unit, the second cracking unit, and the first separator, and to generate a condensable hydrocarbon liquid and a non-condensable gas. The condensable hydrocarbon liquid is processed with hydrocarbonaceous streams from the method to produce the liquid hydrocarbon product, such as synthetic crude oil or pyrolysis oil.

The system 200 further includes a first separation unit 214 with a third inlet and a fourth outlet. The third inlet is connected to and in fluid communication with the second outlet to receive the slurry stream 212. The first separation unit 214 is configured to produce an inorganic products-rich stream 216 and a second hydrocarbonaceous stream 218 containing the residual hydrocarbons. The system further includes a distillation unit 220 with a fourth inlet, a fifth outlet, and a sixth outlet. The fourth inlet is connected to and in fluid communication with the third outlet to receive the first hydrocarbonaceous stream 210 and with the fourth outlet to receive the second hydrocarbonaceous stream 218. In an embodiment, the first hydrocarbonaceous stream 210 and the second hydrocarbonaceous stream 218 can be combined before being supplied to the distillation unit 220. The distillation unit 220 is configured to produce a distillate stream 222 and a bottoms stream 224 containing residual hydrocarbons, metals, and residual inorganic products. The distillation unit 220 can be optimized to ensure that heteroatoms (metals) are separated in the bottoms stream 224 and thus, reducing metal content in the distillate stream 222. The system further includes a second separation unit 226 with a fifth inlet and a seventh outlet. The fifth inlet is connected to and in fluid communication with the sixth outlet to receive the bottoms stream 224. The second separation unit 226 is configured to remove the metals and the residual inorganic products and to produce a recovered hydrocarbon stream 228. The system further includes a mixer 230 with a sixth inlet and a seventh inlet. The sixth inlet is connected to and in fluid communication with the fifth outlet to receive the recovered hydrocarbon stream 228. The seventh inlet is connected to and in fluid communication with the seventh outlet to receive the distillate stream 222. The mixer is configured to combine the recovered hydrocarbon stream 228 and the distillate stream 222 to produce the liquid hydrocarbon product 232. Certain embodiments can also include a washing system to decontaminate the liquid hydrocarbon product by removing heteroatoms.

In certain embodiments, the second separator is avoided by removing all solids from the inorganic products-rich stream in a melt filtration unit/settler. In certain embodiments, the inorganic products-rich stream from the first separation unit is processed in a coker for removing heteroatoms out of the product.

Figure 3:
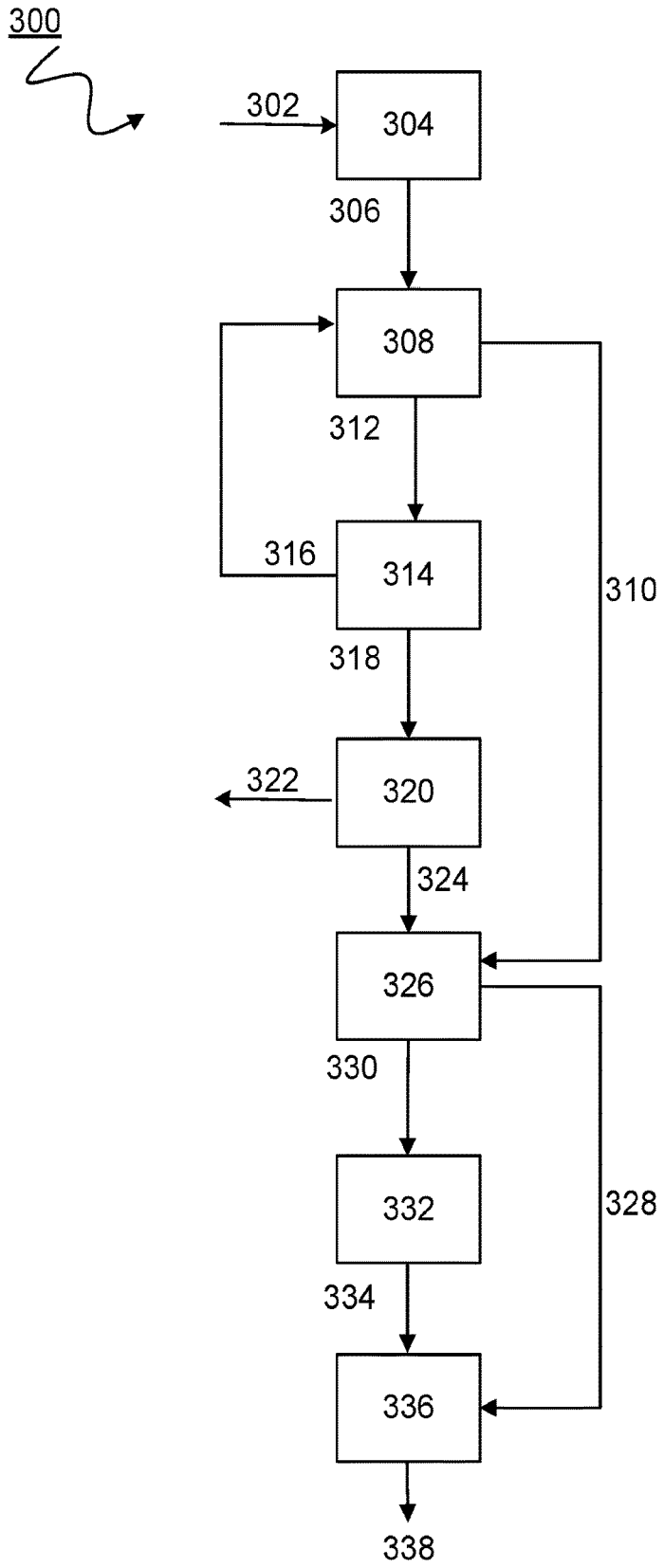
FIG. 3 is a block diagram of a system for processing a mixed plastic waste feed to produce a liquid hydrocarbon product, such as synthetic crude oil or pyrolysis oil, according to another embodiment.

FIG. 3 is a block diagram of a system 300 for processing a mixed plastic waste feed 302 to produce a liquid hydrocarbon product, such as synthetic crude oil or pyrolysis oil, according to another embodiment. This system 300 includes a first cracking unit 304 with a first inlet, a mixing element, and a first outlet. The first inlet has an opening to receive therethrough a mixed plastic waste feed 302 containing a plurality of plastic polymers. This first cracking unit 304 further contains a heat source to heat the mixed plastic waste feed to a temperature sufficient to at least partially depolymerize the plurality of plastic polymers in the mixed plastic waste feed 302 to produce a molten oligomers product stream 306 containing inorganic products from the mixed plastic waste feed. The first cracking unit 304 can be a reactor equipped with an extruder, an auger, a screw, a kneader, a disk ring reactor, a kiln, a stirred tank reactor, a tubular reactor, or combinations thereof. In an embodiment, the molten oligomers product stream 306 contains less than ten weight percent (10 wt. %) of additional aromatics not present in feed. In certain embodiments, the average molecular weight of the molten oligomers product stream 306 is at least twenty times lower than average molecular weight of the mixed plastic waste feed. The system further includes a second cracking unit 308 with a second inlet, a third inlet, a second outlet, and a third outlet. The second inlet is connected to and in fluid communication with the first outlet to receive the molten oligomers product stream 306, and the second cracking unit 308 is configured to contact the molten oligomers product stream 306 with a cracking catalyst to produce a first hydrocarbonaceous stream 310 and a first slurry stream 312 containing a portion of the cracking catalyst, the inorganic products, and residual hydrocarbons. The system 300 further includes a first separation unit 314 with a fourth inlet, a fourth outlet, and a fifth outlet. The fourth inlet is connected to and in fluid communication with the second outlet to receive the first slurry stream 312. The first separation unit 314 is configured to produce a second slurry stream 318 containing the inorganic products and the residual hydrocarbons and a catalyst-rich stream 316 containing the portion of the cracking catalyst. The fourth outlet is connected to and in fluid communication with the third inlet to supply the catalyst-rich stream 316 to the second cracking unit. The system further includes a second separation unit 320 with a fifth inlet and a sixth outlet. The fifth inlet is connected to and in fluid communication with the fifth outlet to receive the second slurry stream 318. The second separation unit 320 is configured to produce an inorganic products-rich stream 322 and a second hydrocarbonaceous stream 324 containing the residual hydrocarbons. The system further includes a distillation unit 326 with a sixth inlet, a seventh outlet, and an eighth outlet. The sixth inlet is connected to and in fluid communication with the third outlet to receive the first hydrocarbonaceous stream 310 and with the sixth outlet to receive the second hydrocarbonaceous stream 324. The distillation unit 326 is configured to produce a distillate stream 328 and a bottoms stream 330 containing residual hydrocarbons, metals, and residual inorganic products. The system further includes a third separation unit 332 with a seventh inlet and a ninth outlet. The seventh inlet is connected to and in fluid communication with the eighth outlet to receive the bottoms stream 330. The third separation unit 332 is configured to remove the metals and the residual inorganic products and to produce a recovered hydrocarbons stream 334. The system further includes a mixer 336 with an eighth inlet and a ninth inlet. The eighth inlet is connected to and in fluid communication with the seventh outlet to receive the distillate stream 328, and the ninth inlet is connected to and in fluid communication with the ninth outlet to receive the recovered hydrocarbon stream 334. In the mixer, the recovered hydrocarbon stream 334 combines with the distillate stream 328 to produce the liquid hydrocarbon product 338. In an embodiment, the recovered hydrocarbon stream 334 are combined with the distillate stream 328 from the ninth outlet and the seventh outlet, respectively, in the absence of a distinct mixer unit to form the liquid hydrocarbon product, such as synthetic crude oil or pyrolysis oil, that is supplied to a downstream processing unit. For example, the synthetic crude oil can be further processed in a refinery, and the pyrolysis oil can be fed to a steam cracker.

EXAMPLES

Various examples provided below illustrate selected aspects of the various methods of converting mixed plastic waste (MPW) to a liquid hydrocarbon product, such as synthetic crude oil or pyrolysis oil.

Example 1

Cracking of mixed polyolefin feed containing virgin HDPE 23.2 wt. %, LDPE 25.6 wt. %, LLDPE 22 wt. %, PP 29.2 wt. % resins was studied in a devolatilization extruder at different temperature and at different feed rates keeping the rpm of the extruder fixed at 100 rpm. The devolatilization extruder used for the study is a co-rotating twin screw extruder (Type omega 30 series). The length of the barrel is 1472 mm and diameter of the screw is 29.7 mm (L/D=49.56). It consists of 12 devolatilizing barrels which have proportional-controlled-derivative (PID) heating and cooling arrangement through programmable logic controller (PLC). There were 6-barrel vent positions. Heating is done by switching solid-state relay to the control power to the heater assembled to the barrel and the cooling is achieved by passing nitrogen operated by solenoid valves. The melt stream flowing out of the extruder was collected and analyzed for aromatics. Infrared (IR) analysis indicated no aromatics formation even at an extruder temperature of 450° C. Gel permeation chromatography (GPC) analysis of the samples showed a significant drop in molecular weight. It is essential to keep the extruder conditions and residence time such that there was significant cracking and lowering of molecular weight but did not allow formation of new aromatics in the process.

About 50 g of the output from the extruder unit at 450° C. at 100 rpm (1.1 kg/hr feed rate, 5827 mol. wt.) was charged into a round bottom flask along with 2.5 g of ZSM-5 commercial FCC additive and the mixture was cracked at 420° C. for 30 minutes. The liquid recovery was 95% with the balance resolved as non-condensable gas and some condensable product. The product material was liquid at around 110° C. and is suitable to be transported from a remote facility to a centralized facility. The results showed that the liquid product boiling below 216° C. had 5.4 vol % aromatics by using a detailed hydrocarbon analyzer GC (ASTM D6730) and the product boiling>216° C. had an aromatic Carbon distribution of 0.3% in relation to 100% allocated to saturates analyzed by C13 NMR spectra. So, on an overall crude oil product basis, (which is a combination of product boiling<216° C. and product boiling>216° C.), the aromatic content is <5 wt %. This product resembles crude oil but with a higher hydrogen content (14.6 wt. %). This product is suitable as a feed for refinery as a synthetic crude oil. The overall liquid yield from a combination of the first and second cracking steps is of the order of 91 wt. % of mixed polyolefin feed. Table 1 shows the potential for recovering maximum liquids through a process disclosed herein in FIG. 1.

TABLE 1

| | H, Wt. % | C, Wt. % |
|---|---|---|
| Whole Regular crude oil | 12.3* | 85.1 |
| Whole synthetic crude oil from plastics cracking | 14.6 | 85.4 |
| Regular crude oil cut boiling at <350 C. | 13.6* | 85.2 |
| Synthetic crude oil cut boiling at <350 C. | 14.8 | 85.4 |
| Regular crude oil cut boiling at >350 C. | 11.4* | 88.6 |
| Synthetic Crude oil cut boiling at >350 C. | 14.4 | 85.9 |

*Normalized to C, H content basis

Example 2

About 50 g of the output from the extruder unit from Example 1 at 450° C. at 100 rpm (1.1 kg/hr feed rate, 5827 mol. wt.) was charged into a round bottom flask along with 2.5 g of cobalt octanoate (a representative liquid cracking catalyst from among metal naphthenates and octanoates) and the mixture was cracked at 420° C. for 30 min. The liquid recovery was about 95 wt. % (out of 52.5 g of material charged) with the balance resolved as gas (condensable and non-condensable). The product material was liquid at around 110° C. and is suitable to be transported from remote facility to a centralized facility. The material contained no aromatics. The cobalt octanoate (a representative liquid cracking catalyst from among metal naphthenates and octanoates) gives good cracking performance. In an embodiment, this additive can be used in the extruder unit along with plastics to accelerate the rate of depolymerization in the continuous feeding device. Similarly based on Example 2, ZSM-5 can also be added along with plastic feed in the extruder to accelerate the rate of depolymerization in the partial depolymerization unit (extruders/twin screw reactor/auger reactor/kneader/disk ring reactor/kiln). Other accelerators that can be used in the first cracking step are peroxides, oxygenates, oxygen, and other oxygen containing compounds.

Example 3

About 150 g of post-consumer mixed plastics waste containing high density polyethylene (HDPE) at 23.2 wt. %, low-density polyethylene (LDPE) at 25.6 wt. %, linear low-density polyethylene (LLDPE) at 22 wt. %, and polypropylene (PP) at 29.2 wt. % was mixed with 7.5 g of 15% Mg on ZSM-5 and the reaction conducted in a round bottom flask at 420° C. for 60 minutes. An analysis of liquid products by detailed hydrocarbon profiling (ASTM D6730) showed a paraffin to iso-paraffin ratio of 1.7 in the liquid products. This is an important characteristic for maximizing ethylene yield in steam cracker. The Mg/ZSM-5 also helps in scavenging any chlorides present. The yield of liquid products was 90% of feed charged. Gas yield was ~5 wt % and inorganics was about 5 wt %. The liquid product is obtained as 67% light hydrocarbon cut (first hydrocarbon stream) and balance as heavy hydrocarbon cut (Residual hydrocarbon stream). The boiling point distribution of these cuts are as shown in Table 2 and together they would represent a whole synthetic crude oil.

TABLE 2

| Mass % | Light Hydrocarbon cut boiling point, ° C. | Heavy hydrocarbon cut boiling point, ° C. |
|---|---|---|
| 0 | 36 | 233 |
| 5 | 42.8 | 328.4 |
| 10 | 63.8 | 356 |
| 30 | 151.8 | 414.8 |
| 50 | 228 | 472 |
| 70 | 285.8 | 535.6 |
| 90 | 348.4 | 642.6 |
| 95 | 371.8 | 685.8 |
| 99 | 409.8 | 731.6 |
| 100 | 422 | 740 |

Figure 4A:
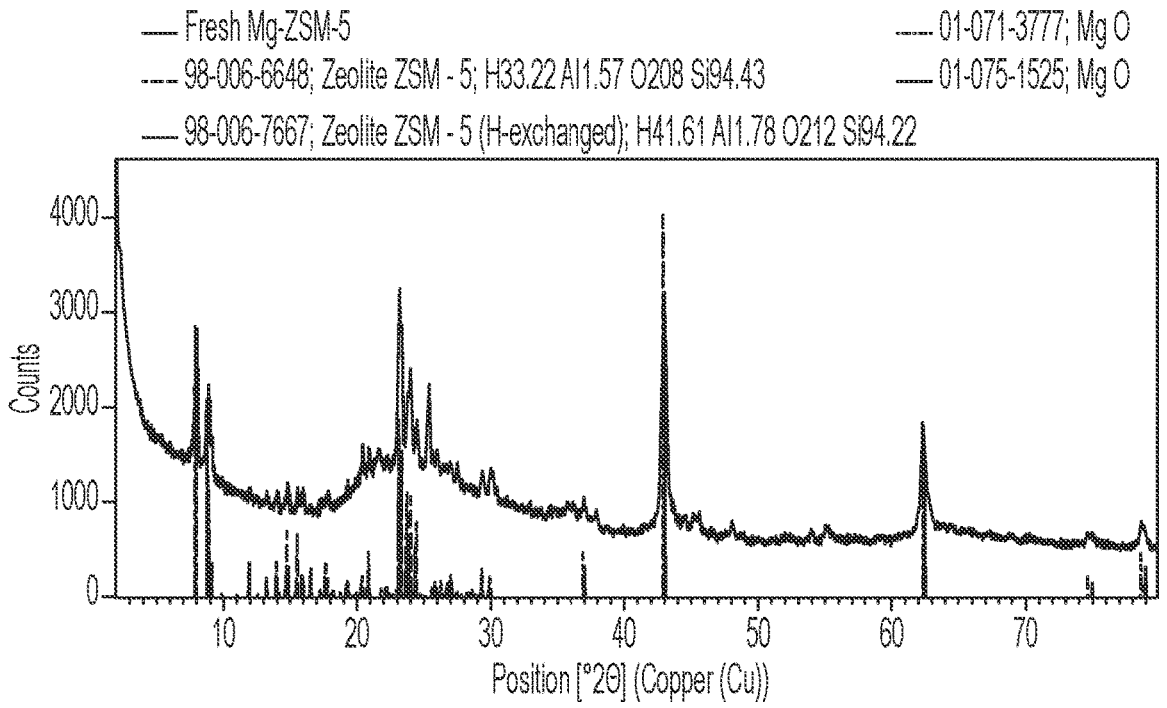
FIGS. 4A-4C are the XRD pattern of fresh Mg-ZSM-5 catalyst (FIG. 4A), the recovered catalyst from the process (FIG. 4B), and the recovered inorganics residue (FIG. 4C).
Figure 4B:
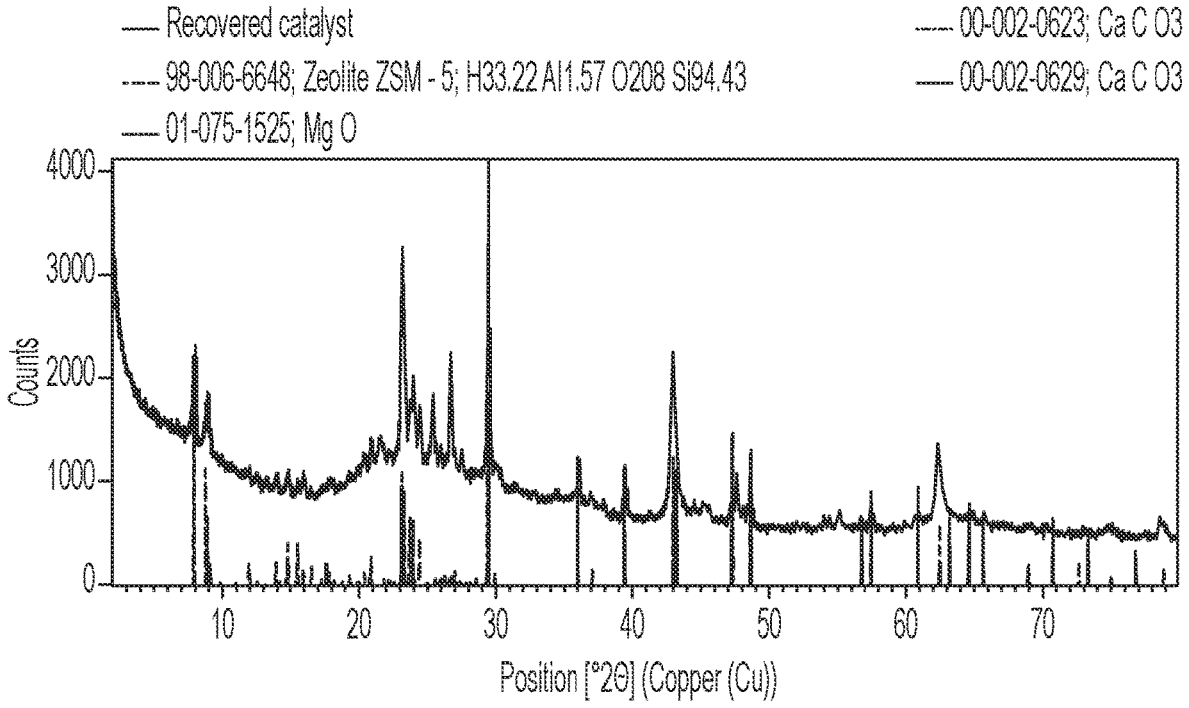
Figure 4C:
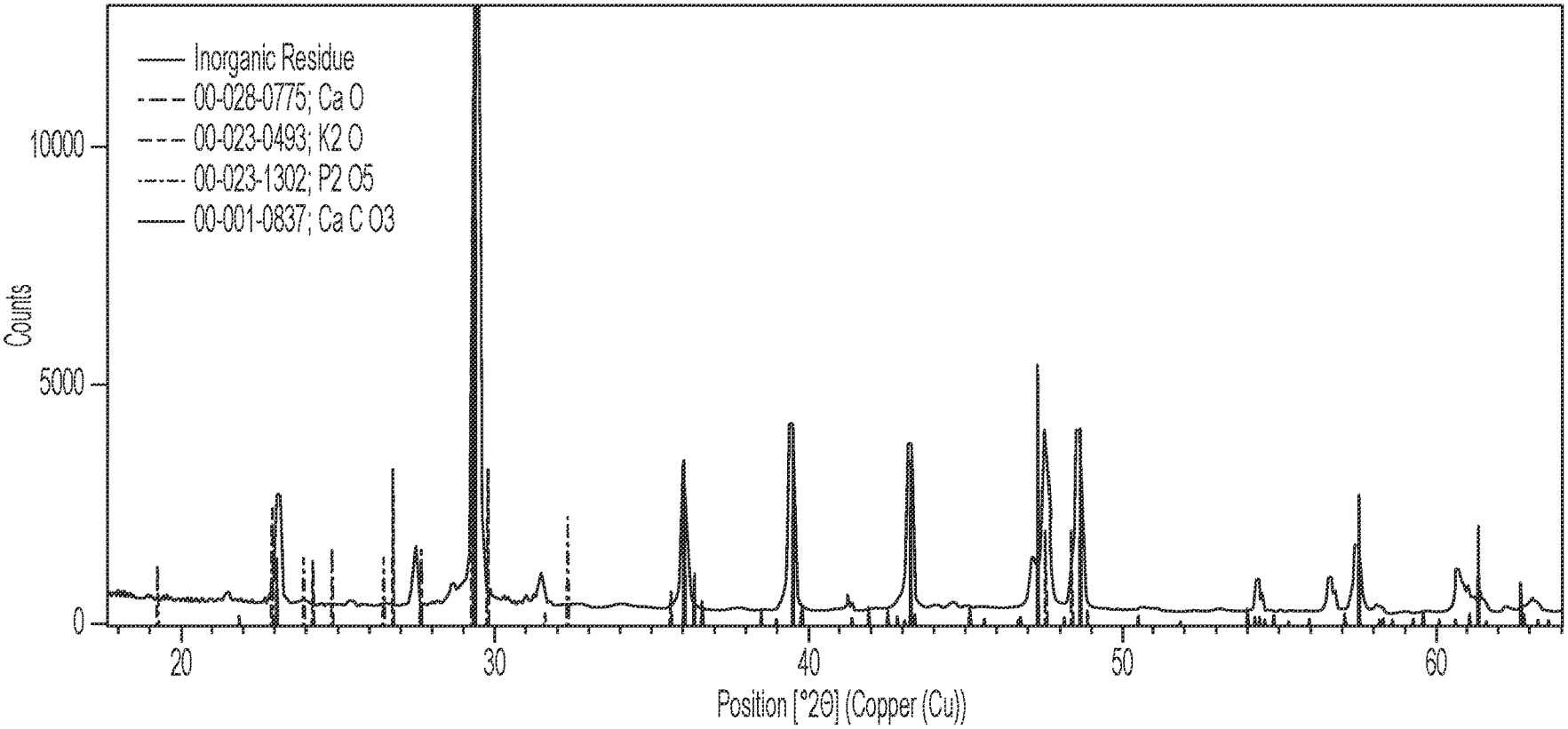

The solids were separated to give a catalyst-rich solid and an inorganic-rich solid. The XRD comparison of the fresh catalyst used (FIG. 4A) and the recovered catalyst (catalyst-rich solid (FIG. 4B)) showed that they are comparable. The catalyst-rich solid had a small content of inorganic components. The inorganic-rich solid fraction (FIG. 4C) showed no presence of ZSM-5 and contained different metals. The XRD pattern of fresh Mg-ZSM-5 catalyst is compared to the XRD patterns of the recovered catalyst from the process and the recovered inorganics residue. The comparison indicates that the XRD patterns of recovered catalyst and fresh catalysts are similar except for presence of small quantities of Ca salts in recovered catalyst. The XRD pattern of the inorganic residue clearly shows presence of Calcium, potassium and phosphorous species and no presence of zeolites.

Example 4

Figures 5A, 5B, 5C, 5D:
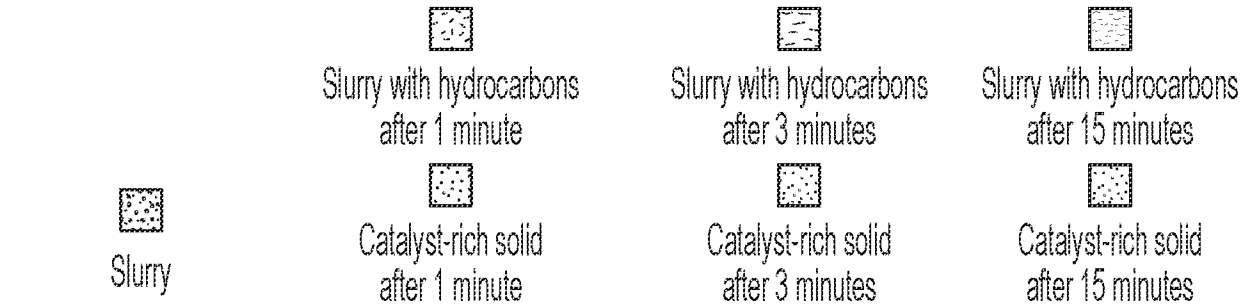
FIGS. 5A-5D are photographic images of the slurry settling system with a mixture of a portion of the hydrocarbon stream and the catalyst-rich solid, and would represent separation of catalyst from the second catalytic cracking unit for the hydrocarbons.

About 37 g of the cracked hydrocarbon stream from Example 3 was mixed with about 1.85 g of catalyst-rich solid. The mixture was shaken thoroughly in a separating funnel and allowed to settle. Within a minute, a solid layer was seen at the bottom of the funnel and in about three minutes, a clear solid layer was seen and in less than five minutes, the catalyst-rich solid settles down completely. This example shows clearly that catalysts can settle very rapidly and can be separated from hydrocarbon streams and can be recycled back to reactor for reuse FIGS. 5A-5D are photographic images of the slurry settling system with a mixture of a portion of the hydrocarbon stream and the catalyst-rich solid. When hot filter is used downstream of the first cracking unit, most of the inorganics are removed. In such a case, FIGS. 5A-5D would represent separation of catalyst from the second catalytic cracking unit for the hydrocarbons. FIG. 5A is a photograph of the slurry settling system with a portion of the hydrocarbon stream from Example 4. FIG. 5B is a photograph of the slurry settling system with a portion of the hydrocarbon stream and a catalyst-rich solid after one minute of settling process. FIG. 5C is a photograph of the slurry settling system with a portion of the hydrocarbon stream and a catalyst-rich solid after three minutes of the settling process. FIG. 5D is a photograph of the slurry settling system with a portion of the hydrocarbon stream and a catalyst-rich solid after fifteen minutes of the settling process.

Example 5

To the contents of the separating funnel in Example 4, a portion of the inorganic-rich solid from Example 3 (3.3 g) was added and the mixture was shaken thoroughly in a separating funnel and allowed to settle. Within one minute, a catalyst-rich solid layer was seen at the bottom of the funnel. And, in three minutes, a clearly demarcated catalyst-rich solid layer was observed. In about five minutes, the catalyst-rich solid settled down. However, the inorganic-rich solid did not settle down within this period. This indicated that a catalyst-rich solid can be separated from an inorganic-rich solid preferentially in a time of less than 5 min in a slurry settling operation. This separation process can thus be advantageously employed in an industrial slurry settler with such reduced settling time.

Figures 6A, 6B, 6C, 6D:
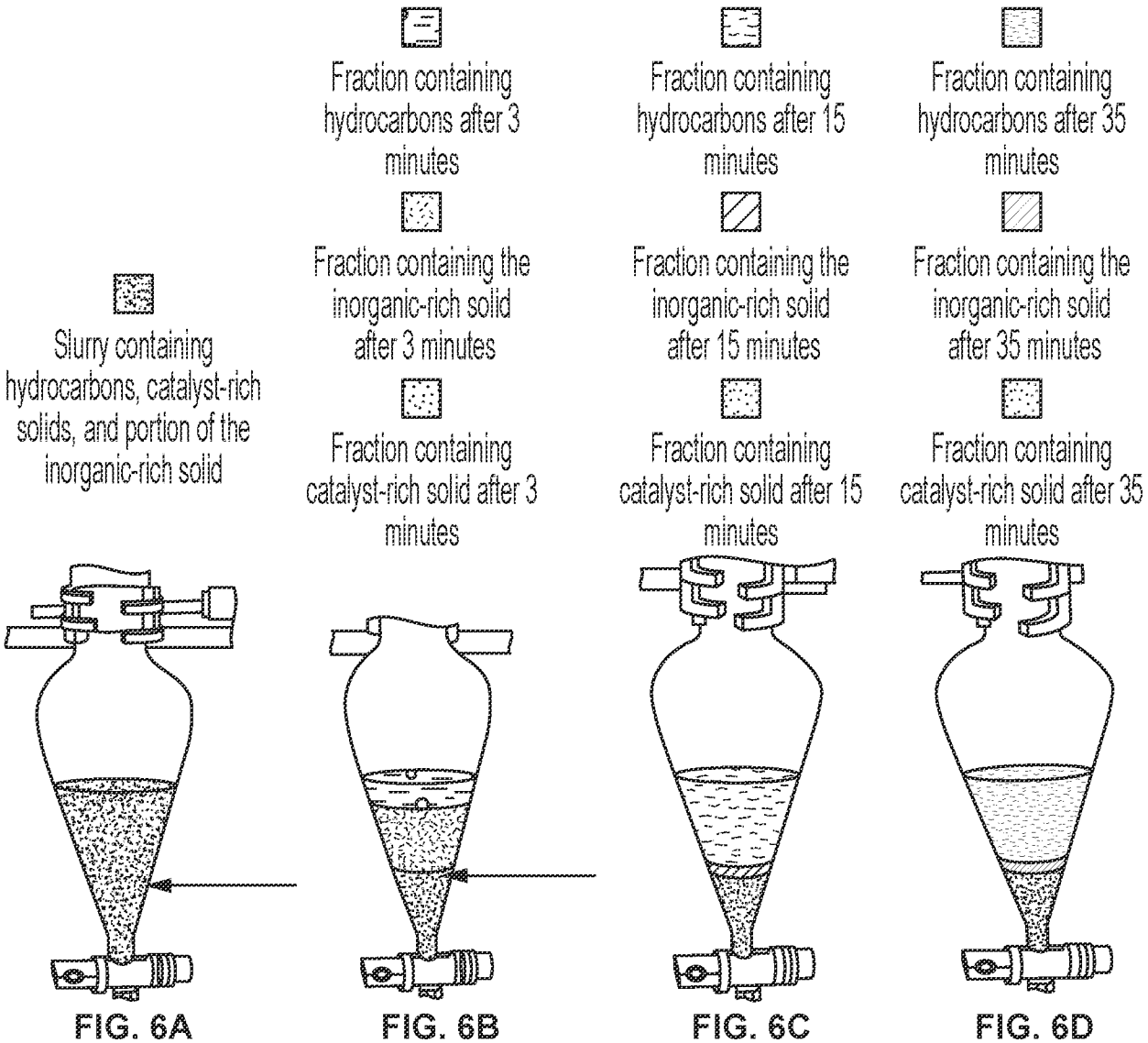
FIGS. 6A-6D are photographic images of the slurry settling system for separation of the catalyst-rich solid from the mixture of the hydrocarbon stream and the inorganic-rich solid.

FIGS. 6A-6D are photographic images of the slurry settling system for separation of the catalyst-rich solid from the mixture of the hydrocarbon stream and the inorganic-rich solid. When no hot filter or other separation process is used downstream of the first cracking unit, inorganics and catalyst need to be separated from the hydrocarbons exiting the second catalytic cracking unit. FIGS. 6A-6D illustrate this separation. FIG. 6A is a photograph of the slurry settling system within one minute of mixing the contents of the separating funnel in Example 5 with a portion of the inorganic-rich solid from Example 4. FIG. 6B is a photograph of the slurry settling system with the catalyst-rich solid beginning to separate from the mixture of the hydrocarbon stream and the inorganic-rich solid after three minutes of the settling process. FIG. 6C is a photograph of the slurry settling system with the catalyst-rich solid clearly separating from the mixture of the hydrocarbon stream and the inorganic-rich solid after fifteen minutes of the settling process. FIG. 6D is a photograph of the slurry settling system with the catalyst-rich solid well separated from the mixture of the hydrocarbon stream and the inorganic-rich solid after 35 minutes of the settling process.

Example 6

The viscosity of oligomer from Example 1 from extruder studies (450° C., 1.1 kg/hr and 100 rpm) was measured as a function of temperature in a Brookfield viscometer using No. 5 spindle. The results are as indicated in Table 3.

TABLE 3

| Temperature, ° C. | Viscosity, cP |
|---|---|
| 173 | 76 |
| 186 | 56 |
| 192 | 52 |
| 202 | 48 |
| 204 | 44 |
| 214 | 40 |
| 220 | 32 |
| 231 | 28 |
| 241 | 24 |
| 246 | 20 |
| 250 | 16 |
| 265 | 8 |
| 268 | 4 |

As per viscosity data above, viscosity at 268° C. was 4 cP. So, it is expected that viscosity at 450° C. would be 1 cP or lower. So, settling studies as shown in Example 5 (low viscosity material) is applicable also to the low viscosity oligomer product stream from the first cracking unit. Thus, these inorganic residues in the oligomer product can be removed by settling or filtration.

Example 7

Cracking of mixed polyolefin feed containing virgin HDPE 23.2 wt. %, LDPE 25.6 wt. %, LLDPE 22 wt. %, PP 29.2 wt. % resins was studied in a devolatilization extruder at 400° C., 1.3 Kg/hr and 100 rpm. About 300 g of oligomer product obtained from the first cracking step was fed to a tank reactor and cracked at 420° C. for 45 min. Liquid product recovered was 91.4 wt. %. The boiling point distribution of the liquid product was as shown in Table 4 and is in crude oil boiling range even though it would represent a heavier crude with 30% boiling below 380° C. and 25% boiling below 329° C. The product can be made lighter by increasing residence time or temperature in the tank reactor. In comparison, the product from plastic cracking using catalyst (Example 2) had 60% boiling at ~380° C. and 50% boiling at ~324° C.

TABLE 4

| Mass % | Boiling Point, ° C. |
|---|---|
| 0 | 36 |
| 5 | 125.8 |
| 10 | 174.6 |
| 30 | 381 |
| 50 | 532 |
| 70 | 623 |
| 90 | 708 |
| 95 | 727.4 |
| 99 | 744.8 |
| 100 | 747.2 |

Example 8

Post-consumer mixed plastic feed 150 g containing 90% polyolefin, 8% polystyrene, 1% PVC and 1% PET was mixed with 7.5 g of catalyst (80 wt. % spent FCC catalyst and 20 wt. % of 15% Mg-ZSM-5 catalyst) and cracked in a flask at 420° C. for 1 hr. The liquid product yield was 89.2 wt. %, the gas yield was 5.6 wt. % and inorganics residue was 5.2 wt. %. The liquid product is obtained as 72% light hydrocarbon cut (first hydrocarbon stream) and balance as heavy hydrocarbon cut (Residual hydrocarbon stream). The boiling point distribution of these cuts are shown in Table 5 and together they would represent a whole synthetic crude oil.

TABLE 5

| Mass % | Light Hydrocarbon cut boiling point, ° C. | Heavy hydrocarbon cut boiling point, ° C. |
|---|---|---|
| 0 | 36 | 207.4 |
| 5 | 36 | 296.6 |
| 10 | 87 | 328.6 |
| 30 | 132.2 | 390.2 |
| 50 | 183.6 | 431.8 |
| 70 | 249.6 | 480.8 |
| 90 | 322.6 | 569 |
| 95 | 353.8 | 622.2 |
| 99 | 418.8 | 708.4 |
| 100 | 465.6 | 726 |

Example 9

Figure 7:
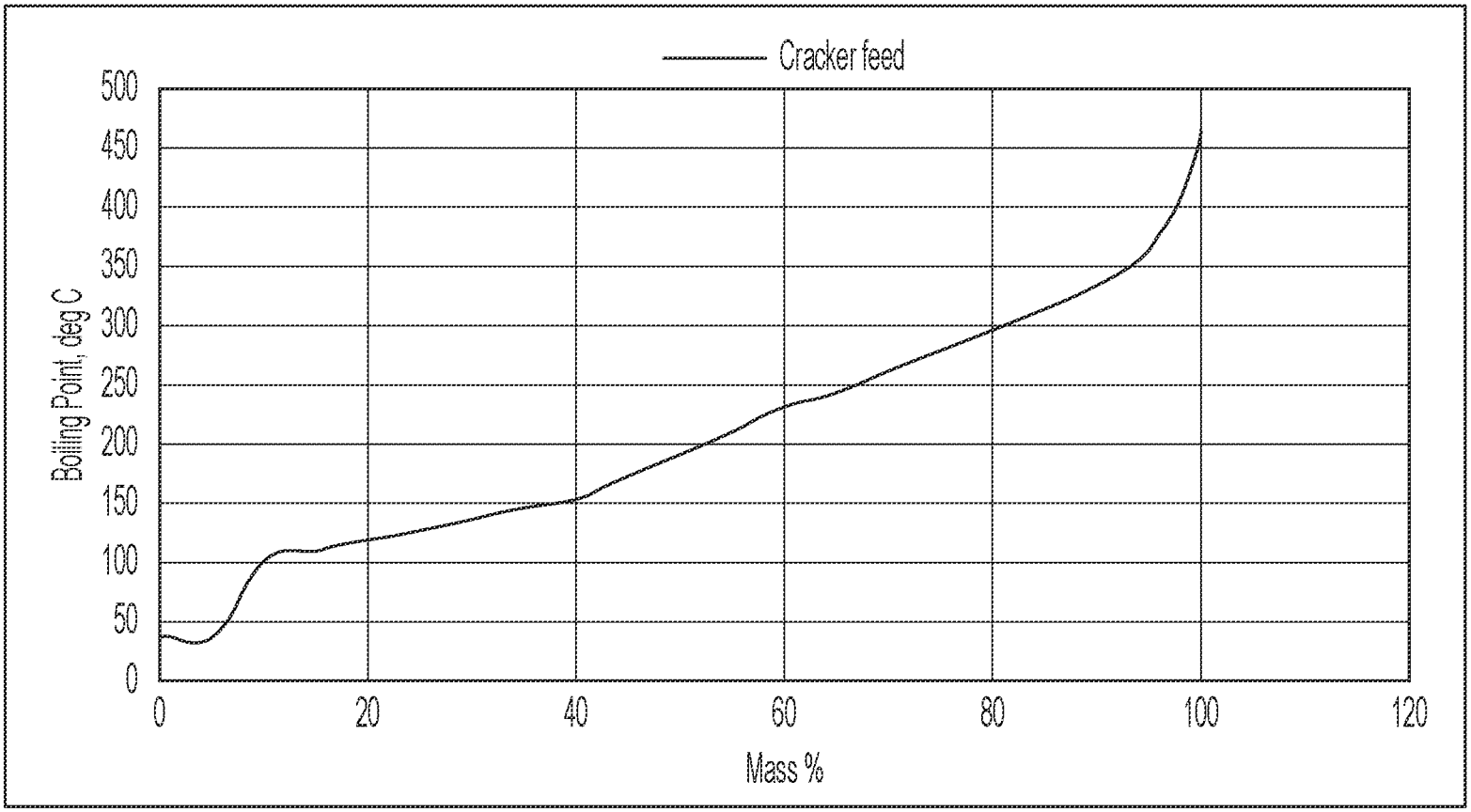
FIG. 7 is a graphical representation of boiling point distribution of the liquid hydrocarbon product generated in an exemplary embodiment.

Post-consumer mixed plastic feed 150 g containing 90% polyolefin, 8% polystyrene, 1% PVC and 1% PET was mixed with 7.5 g of catalyst (80 wt. % spent FCC catalyst and 20 wt. % of 15% Mg-ZSM-5 catalyst) and cracked in a flask at 420° C. for 2.5 hrs. The liquid product yield was 87.7 wt. %, gas yield was 7 wt. % and inorganics residue was 5.3 wt. %. The liquid product boiling point distribution is provided in FIG. 7 and can be used as pyrolysis oil feed to steam crackers.

Example 10

To a mixture containing n-hexadecane 30%, 2,2,4-trimethyl pentane (10%), 1-decene (20%), cyclohexane (20 wt %), ethyl benzene (20 wt %) chloride compounds 2-chloropentane, 3-chloro-3-pentane, 1-chloro hexane, (2-chloroethyl)benzene and chlorobenzene were added to get a total of 204 ppm in the mixture and in another case 1100 ppm in mixture. These feeds were contacted with hydrotreating Co—Mo on alumina catalyst and results of this treatment are provided in Table 6.

TABLE 6

| Cl in feed, ppw | Temperature, deg ° C. | Pressure, barg | WHSV, hr-1 | H2/Hydrocarbon ratio, NL/L | Product Cl content, ppmw | Product olefin content, wt. % |
|---|---|---|---|---|---|---|
| 204 | 300 | 10 | 0.9 | 414 | <1 ppmw | 0 |
| 1100 | 300 | 40 | 0.9 | 414 | <1 ppmw | 0.1 |

This example is provided to illustrate the ability to remove Cl and olefins to <1 ppmw and <1 wt. % in products using a hydrogenation catalyst without cracking functionality. In the second catalytic reactor in this application, the cracking catalyst can be loaded with Ni and Mg can provide the cracking, hydrogenation and chloride scavenging functionality. The low pressures of 10 bar gauge in the above example, clearly demonstrate the ability to use low pressures for the chloride removal and hydrogenation activity in the second catalytic reactor.

The systems and processes described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown. Other objects, features and advantages of the disclosure will become apparent from the following figures, detailed description, and examples. It should be understood, however, that the figures, detailed description, and examples, while indicating specific embodiments of the disclosure, are given by way of illustration only and are not meant to be limiting. Additionally, it is contemplated that changes and modifications within the spirit and scope of the disclosure will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

What is claimed is:

1. A method of processing a mixed plastic waste feed to produce a liquid hydrocarbon product, the method comprising:

introducing a mixed plastic waste feed containing a plurality of plastic polymers to a first cracking unit;

operating the first cracking unit at a temperature and a residence time sufficient to at least partially depolymerize the plurality of plastic polymers in the mixed plastic waste feed to produce a molten oligomers product stream containing inorganic products from the mixed plastic waste feed and a gas stream containing volatile hydrocarbons and heteroatoms;

supplying the molten oligomers product stream to a second cracking unit containing a cracking catalyst to produce a first hydrocarbonaceous stream and a first slurry stream, the second cracking unit being a continuous cracking unit and the first slurry stream containing a portion of the cracking catalyst, the inorganic products, and residual hydrocarbons;

passing the first slurry stream from the second cracking unit to a first separation unit to produce a second slurry stream containing the inorganic products and the residual hydrocarbons and a catalyst-rich stream containing the portion of the cracking catalyst;

supplying the catalyst-rich stream to the second cracking unit;

introducing the second slurry stream to a second separation unit to produce a second hydrocarbonaceous stream containing the residual hydrocarbons and an inorganic products-rich stream;

delivering the first hydrocarbonaceous stream and the second hydrocarbonaceous stream to a distillation unit to produce a distillate stream and a bottoms stream containing residual hydrocarbons, metals, and residual inorganic products;

processing the bottoms stream in a third separation unit to remove the metals and the residual inorganic products and to produce a recovered hydrocarbon stream; and mixing the recovered hydrocarbon stream and the distillate stream to produce a liquid hydrocarbon product.

2. The method of claim 1, wherein the cracking catalyst favors production of the first hydrocarbonaceous stream with greater paraffin content as compared to iso-paraffin content.

3. The method of claim 1, wherein hydrogen gas is supplied to the second cracking unit to produce the first hydrocarbonaceous stream with chloride levels of less than 1 ppmw and olefin content of less than 1 wt. %.

4. The method of claim 1, wherein the first cracking unit is operated at the temperature ranging from about 300° C. to about 500° C. and the residence time of less than 1 hour.

5. The method of claim 1, wherein the first cracking unit is a reactor equipped with an extruder, an auger, a screw, a kneader, a disk ring reactor, a kiln, a stirred tank reactor, a tubular reactor or combinations thereof.

6. The method of claim 1, wherein the second separation unit is a coking unit and the second slurry stream is processed to remove the inorganic products as coke.

7. The method of claim 1, wherein the third separation unit is a coking unit and the bottoms stream is processed to remove the residual inorganic products as coke.

8. The method of claim 1, further comprising:

passing the molten oligomers product stream to a melt filtration unit to remove a portion of the inorganic products and insoluble components before supplying the molten oligomer product stream to the second cracking unit.

9. The method of claim 1, further comprising:

collecting the molten oligomers product stream in a holding tank to remove heteroatoms as volatiles before supplying the molten oligomer product stream to the second cracking unit.

10. The method of claim 9, further comprising:

passing a gas stream through the molten oligomers product stream in the holding tank to remove heteroatoms as volatiles before supplying the molten oligomer product stream to the second cracking unit.

11. The method of claim 1, further comprising:

passing the molten oligomers product stream to a separation unit to remove one or more light gases containing volatile hydrocarbons rich in one or more of chloride, nitride, and sulfide before supplying the molten oligomer product stream to the second cracking unit.

12. The method of claim 11, wherein the separation unit is a vacuum separation unit.

13. The method of claim 1, further comprising:

adding a depolymerization additive to the mixed plastic waste feed in the first cracking unit, the depolymerization additive being one or more of a depolymerization accelerator, a peroxide, an organometallic compound, or the cracking catalyst.

14. The method of claim 1, wherein average molecular weight of the molten oligomers product stream is at least twenty times lower than average molecular weight of the mixed plastic waste feed.

15. A system for processing a mixed plastic waste feed to produce a liquid hydrocarbon product, the system comprising:

a first cracking unit having a first inlet, a mixing element, and a first outlet, the first inlet having an opening to receive therethrough a mixed plastic waste feed containing a plurality of plastic polymers, the first cracking unit further containing a heat source to heat the mixed plastic waste feed to a temperature sufficient to at least partially depolymerize the plurality of plastic polymers in the mixed plastic waste feed to produce a molten oligomers product stream containing inorganic products from the mixed plastic waste feed;

a second cracking unit having a second inlet, a third inlet, a second outlet, and a third outlet, the second inlet being connected to and in fluid communication with the first outlet to receive the molten oligomers product stream, and the second cracking unit being configured to contact the molten oligomers product stream with a cracking catalyst to produce a first hydrocarbonaceous stream and a first slurry stream containing a portion of the cracking catalyst, the inorganic products, and residual hydrocarbons;

a first separation unit having a fourth inlet, a fourth outlet, and a fifth outlet, the fourth inlet being connected to and in fluid communication with the second outlet to receive the first slurry stream, the first separation unit being configured to produce a second slurry stream containing the inorganic products and the residual hydrocarbons and a catalyst-rich stream containing the portion of the cracking catalyst, the fourth outlet being connected to and in fluid communication with the third inlet to supply the catalyst-rich stream to the second cracking unit;

a second separation unit having a fifth inlet and a sixth outlet, the fifth inlet being connected to and in fluid communication with the fifth outlet to receive the second slurry stream, the second separation unit being configured to produce an inorganic products-rich stream and a second hydrocarbonaceous stream containing the residual hydrocarbons;

a distillation unit having a sixth inlet, a seventh outlet, and an eighth outlet, the sixth inlet being connected to and in fluid communication with the third outlet to receive the first hydrocarbonaceous stream and with the sixth inlet-outlet to receive the second hydrocarbonaceous stream, the distillation unit being configured to produce a distillate stream and a bottoms stream containing the residual hydrocarbons, metals, and residual inorganic products;

a third separation unit having a seventh inlet and a ninth outlet, the seventh inlet being connected to and in fluid communication with the eighth outlet to receive the bottoms stream, the third separation unit being configured to remove the metals and the residual inorganic products and to produce a recovered hydrocarbon stream; and a mixer having an eighth inlet and a ninth inlet, the eighth inlet being connected to and in fluid communication with the seventh outlet to receive the distillate stream, the ninth inlet being connected to and in fluid communication with the ninth outlet to receive the recovered hydrocarbon stream; and the mixer being configured to combine the recovered hydrocarbon stream and the distillate stream to produce the liquid hydrocarbon product.

16. The system of claim 15, wherein the first cracking unit is a reactor equipped with an extruder, an auger, a screw, a kneader, a disk ring reactor, a kiln, a stirred tank reactor, a tubular reactor or combinations thereof.

17. The system of claim 15, wherein the cracking catalyst favors production of the first hydrocarbonaceous stream with greater paraffin content as compared to iso-paraffin content.

18. A system for processing a mixed plastic waste feed to produce a liquid hydrocarbon product, the system comprising:

a first cracking unit having a first inlet, a mixing element, and a first outlet, the first inlet having an opening to receive therethrough a mixed plastic waste feed containing a plurality of plastic polymers, the first cracking unit further containing a heat source to heat the mixed plastic waste feed to a temperature sufficient to at least partially depolymerize the plurality of plastic polymers in the mixed plastic waste feed to produce a molten oligomers product stream containing inorganic products from the mixed plastic waste feed;

a second cracking unit having a second inlet, a second outlet, and a third outlet, the second inlet being connected to and in fluid communication with the first outlet to receive the molten oligomers product stream, and the second cracking unit being a thermal cracking unit configured to process the molten oligomers product stream to produce a first hydrocarbonaceous stream and a slurry stream containing the inorganic products and residual hydrocarbons;

a first separation unit having a third inlet and a fourth outlet, the third inlet being connected to and in fluid communication with the second outlet to receive the slurry stream, the first separation unit being configured to produce an inorganic products-rich stream and a second hydrocarbonaceous stream containing the residual hydrocarbons;

a distillation unit having a fourth inlet, a fifth outlet, and a sixth outlet, the fourth inlet being connected to and in fluid communication with the third outlet to receive the first hydrocarbonaceous stream and with the fourth outlet to receive the second hydrocarbonaceous stream, the distillation unit being configured to produce a distillate stream and a bottoms stream containing the residual hydrocarbons, metals, and residual inorganic products;

a second separation unit having a fifth inlet and a seventh outlet, the fifth inlet being connected to and in fluid communication with the sixth outlet to receive the bottoms stream, the second separation unit being configured to remove the metals and the residual inorganic products and to produce a recovered hydrocarbon stream; and a mixer having a sixth inlet and a seventh inlet, the sixth inlet being connected to and in fluid communication with the fifth outlet to receive the recovered hydrocarbon stream, the seventh inlet being connected to and in fluid communication with the seventh outlet to receive the distillate stream; and the mixer being configured to combine the recovered hydrocarbon stream and the distillate stream to produce the liquid hydrocarbon product.

19. The system of claim 18, wherein the first cracking unit is a reactor equipped with an extruder, an auger, a screw, a kneader, a disk ring reactor, a kiln, a stirred tank reactor, a tubular reactor or combinations thereof.

20. The system of claim 18, wherein the cracking catalyst favors production of the first hydrocarbonaceous stream with greater paraffin content as compared to iso-paraffin content.

* * * * *